US007556903B2

(12) United States Patent
Yanagawa et al.

(10) Patent No.: US 7,556,903 B2
(45) Date of Patent: Jul. 7, 2009

(54) ELECTROPHOTOGRAPHIC PHOTORECEPTOR, AND IMAGE FORMING METHOD, APPARATUS AND PROCESS CARTRIDGE THEREFOR USING THE PHOTORECEPTOR

(75) Inventors: Yoshiki Yanagawa, Numazu (JP); Hiroshi Ikuno, Yokohama (JP); Hongguo Li, Numazu (JP); Kazukiyo Nagai, Numazu (JP); Hiroshi Tamura, Susono (JP); Tetsuro Suzuki, Fuji (JP)

(73) Assignee: Ricoh Company Limited, Tokyo (JP)

( * ) Notice: Subject to any disclaimer, the term of this patent is extended or adjusted under 35 U.S.C. 154(b) by 278 days.

(21) Appl. No.: 10/944,003

(22) Filed: Sep. 20, 2004

(65) Prior Publication Data

US 2005/0266328 A1 Dec. 1, 2005

(30) Foreign Application Priority Data

Sep. 19, 2003 (JP) ..... 2003-329178

(51) Int. Cl.
*G03G 5/047* (2006.01)
*G03G 5/147* (2006.01)

(52) U.S. Cl. ..... 430/66; 399/159; 430/123.42

(58) Field of Classification Search ..... 430/58.15, 430/66, 130, 131, 133, 123.42
See application file for complete search history.

(56) References Cited

U.S. PATENT DOCUMENTS 4,672,149 A 6/1987 Yoshikawa et al.
4,837,120 A 6/1989 Akiyoshi et al.
4,874,481 A 10/1989 Suzuki et al.
4,992,109 A 2/1991 Yoshikawa et al.
5,006,915 A 4/1991 Yoshikawa et al.
5,013,634 A 5/1991 Nagai
5,028,467 A 7/1991 Maruyama et al.
5,087,699 A 2/1992 Nagai
5,126,802 A 6/1992 Yoshikawa et al.
5,145,963 A 9/1992 Nagai
5,153,087 A 10/1992 Tamura et al.
5,201,961 A 4/1993 Yoshikawa et al.
5,264,048 A 11/1993 Yoshikawa et al.
5,322,753 A 6/1994 Tamura et al.

(Continued)

FOREIGN PATENT DOCUMENTS

JP 56-48637 5/1981

(Continued)

OTHER PUBLICATIONS

Machine generated translation of JP 2001-175016, published Jun. 29, 2001.*

(Continued)

*Primary Examiner*—Christopher RoDee
*Assistant Examiner*—Peter L Vajda
(74) *Attorney, Agent, or Firm*—Oblon, Spivak, McClelland, Maier & Neustadt, P.C.

(57) ABSTRACT

An electrophotographic photoreceptor including an electroconductive substrate and a photosensitive layer overlying the electroconductive substrate. An outermost layer of the electrophotographic photoreceptor is a crosslinked layer including a radical polymerizing monomer having three or more functional groups without a charge transporting structure. The outermost layer also includes a radical polymerizing compound having one functional group with a charge transporting structure and a reactive silicone compound having a radical polymerizing functional group.

20 Claims, 2 Drawing Sheets

U.S. PATENT DOCUMENTS 5,350,459 A 9/1994 Suzuki et al.
5,420,288 A 5/1995 Ohta et al.
5,427,880 A 6/1995 Tamura et al.
5,452,061 A 9/1995 Kojima et al.
5,492,784 A 2/1996 Yoshikawa et al.
5,496,671 A 3/1996 Tamura et al.
5,525,447 A 6/1996 Ikuno et al.
5,597,925 A 1/1997 Ohta et al.
5,610,309 A 3/1997 Ohta et al.
5,656,401 A 8/1997 Ohta et al.
5,656,406 A 8/1997 Ikuno et al.
5,702,833 A 12/1997 Nagai et al.
5,709,959 A 1/1998 Adachi et al.
5,723,243 A 3/1998 Sasaki et al.
5,747,204 A 5/1998 Anzai et al.
5,789,128 A 8/1998 Adachi et al.
5,830,980 A 11/1998 Anzai et al.
5,840,454 A 11/1998 Nagai et al.
5,840,455 A 11/1998 Ikuno et al.
5,846,680 A 12/1998 Adachi et al.
5,853,935 A 12/1998 Suzuki et al.
5,870,657 A 2/1999 Nagame et al.
5,871,876 A 2/1999 Ikuno et al.
5,910,561 A 6/1999 Adachi et al.
5,932,362 A 8/1999 Nagai et al.
5,942,363 A 8/1999 Tanaka et al.
5,976,746 A 11/1999 Tanaka et al.
6,018,014 A 1/2000 Nagai et al.
6,027,846 A 2/2000 Shimada et al.
6,030,733 A 2/2000 Kami et al.
6,045,959 A 4/2000 Katayama et al.
6,066,428 A 5/2000 Katayama et al.
6,069,224 A 5/2000 Adachi et al.
6,093,784 A 7/2000 Tamura et al.
6,130,310 A 10/2000 Katayama et al.
6,151,468 A 11/2000 Kami et al.
6,172,176 B1 1/2001 Tanaka et al.
6,187,492 B1 2/2001 Ri et al.
6,187,494 B1 2/2001 Kawamura et al.
6,191,249 B1 2/2001 Tanaka et al.
6,194,535 B1 2/2001 Katayama et al.
6,210,848 B1 4/2001 Nagai et al.
6,303,736 B1 10/2001 Kawamura et al.
6,316,577 B1 11/2001 Shimada et al.
6,326,112 B1 12/2001 Tamura et al.
6,366,751 B1 4/2002 Shakuto et al.
6,416,915 B1 * 7/2002 Kikuchi et al. ..... 430/56
6,432,596 B2 8/2002 Ikuno et al.
6,444,387 B2 9/2002 Ri et al.
6,486,293 B1 11/2002 Ri et al.
6,489,073 B2 12/2002 Kotsugai et al.
6,492,079 B2 12/2002 Shimada et al.
6,548,216 B2 4/2003 Kawamura et al.
6,576,386 B1 6/2003 Ri et al.
6,596,449 B2 7/2003 Shimada et al.
6,625,409 B2 9/2003 Shakuto et al.
6,641,964 B2 11/2003 Ikuno et al.
6,654,579 B2 11/2003 Shakuto et al.
6,664,361 B2 12/2003 Sasaki et al.
6,686,114 B2 2/2004 Sakon et al.
6,790,571 B2 9/2004 Kawamura et al.
6,790,572 B2 9/2004 Tamoto et al.
2002/0018953 A1 * 2/2002 Maruyama et al. ..... 430/130
2002/0076631 A1 * 6/2002 Itami et al. ..... 430/58.2
2002/0081128 A1 6/2002 Shakuto et al.
2002/0090229 A1 7/2002 Shakuto et al.
2003/0059695 A1 * 3/2003 Li et al. ..... 430/66
2003/0077531 A1 4/2003 Suzuki et al.
2003/0190540 A1 10/2003 Shoshi et al.
2003/0198881 A1 10/2003 Kawamura et al.
2003/0224268 A1 12/2003 Ikuno et al.
2004/0002574 A1 1/2004 Ri et al.
2004/0033428 A1 2/2004 Niimi
2004/0048177 A1 * 3/2004 Tamoto et al. ..... 430/58.2
2004/0048178 A1 3/2004 Ikuno et al.
2004/0053152 A1 3/2004 Nagai et al.
2005/0266328 A1 12/2005 Yanagawa et al.

FOREIGN PATENT DOCUMENTS

JP 57-35863 2/1982
JP 62-75641 4/1987
JP 63-061256 3/1988
JP 63-073267 4/1988
JP 64-001728 1/1989
JP 64-035448 2/1989
JP 2-189550 7/1990
JP 04-281461 10/1992
JP 5-12700 2/1993
JP 05-323630 * 7/1993
JP 05-216249 8/1993
JP 7-10912 2/1995
JP 7-19073 3/1995
JP 7-113779 12/1995
JP 08-262779 10/1996
JP 11-344818 12/1999
JP 2000-66425 3/2000
JP 2000-310872 11/2000
JP 2001-166510 6/2001
JP 2001-175016 * 6/2001
JP 2001-175016 A * 6/2001
JP 3194392 6/2001
JP 3262488 12/2001
JP 3286711 3/2002

OTHER PUBLICATIONS

U.S. Appl. No. 11/033,802, filed Jan. 13, 2005, Yanagawa et al.
U.S. Appl. No. 10/944,003, filed Sep. 20, 2004, Yanagawa et al.
U.S. Appl. No. 11/068,180, filed Mar. 1, 2005, Tamoto et al.
U.S. Appl. No. 11/082,833, filed Mar. 18, 2005, Suzuki et al.
U.S. Appl. No. 11/165,279, filed Jun. 24, 2005, Ohshima et al.
U.S. Appl. No. 11/157,060, filed Jun. 21, 2005, Ikuno et al.
U.S. Appl. No. 11/110,937, filed Apr. 21, 2005, Ohshima et al.
U.S. Appl. No. 11/136,488, filed May 25, 2005, Yanagawa et al.
U.S. Appl. No. 11/157,998, filed Jun. 22, 2005, Tamura et al.
U.S. Appl. No. 11/166,853, filed Jun. 27, 2005, Ohshima et al.
U.S. Appl. No. 11/172,989, filed Jul. 5, 2005, Li et al.
U.S. Appl. No. 11/218,657, filed Sep. 6, 2005, Suzuki et al.
U.S. Appl. No. 11/217,407, filed Sep. 2, 2005, Toda et al.
U.S. Appl. No. 11/272,826, filed Nov. 15, 2005, Kawasaki et al.
U.S. Appl. No. 11/270,693, filed Nov. 10, 2005, Li et al.
U.S. Appl. No. 11/229,749, filed Sep. 20, 2005, Ohshima et al.
U.S. Appl. No. 11/261,751, filed Oct. 31, 2005, Ohshima et al.
U.S. Appl. No. 11/317,048, filed Dec. 27, 2005, Nagai et al.
U.S. Appl. No. 11/332,545, filed Jan. 17, 2006, Tamoto et al.
U.S. Appl. No. 11/367,786, filed Mar. 6, 2006, Ohta et al.
U.S. Appl. No. 11/480,517, filed Jul. 5, 2006, Yanagawa et al.
U.S. Appl. No. 11/500,352, filed Aug. 8, 2006, Toshine et al.
U.S. Appl. No. 11/562,203, filed Nov. 21, 2006, Nagai et al.
U.S. Appl. No. 11/561,983, filed Nov. 21, 2006, Sugino et al.
U.S. Appl. No. 11/563,710, filed Nov. 28, 2006, Inaba et al.
U.S. Appl. No. 11/616,523, filed Dec. 27, 2006, Fujiwara et al.
U.S. Appl. No. 08/879,992, filed Sep. 20, 1997.
U.S. Appl. No. 06/900,414, filed Aug. 26, 1986.
U.S. Appl. No. 07/146,183, filed Jan. 20, 1988.
U.S. Appl. No. 08/562,154, filed Nov. 22, 1995.
U.S. Appl. No. 08/854,635, filed May 12, 1997.
U.S. Appl. No. 08/862,260, filed May 23, 1997.
U.S. Appl. No. 09/610,427, filed Jul. 5, 2000, Kawamura et al.
U.S. Appl. No. 10/625,570, filed Jul. 24, 2003, Tamoto et al.
U.S. Appl. No. 11/621,805, filed Jan. 10, 2007, Suzuki et al.
U.S. Appl. No. 11/684,520, filed Mar. 9, 2007, Toshine et al.
U.S. Appl. No. 11/685,441, filed Mar. 13, 2007, Yanagawa et al.
U.S. Appl. No. 11/692,682, filed Mar. 28, 2007, Mori et al.

U.S. Appl. No. 11/736,258, filed Apr. 17, 2007, Kawasaki et al.
U.S. Appl. No. 11/750,570, filed May 18, 2007, Ikuno et al.
U.S. Appl. No. 11/763,853, filed Jun. 15, 2007, Nagai et al.
U.S. Appl. No. 11/834,240, filed Aug. 6, 2007, Hirose et al.
U.S. Appl. No. 11/855,510, filed Sep. 14, 2007, Kami et al.
U.S. Appl. No. 11/926,748, filed Oct. 29, 2007, Yanagawa et al.
U.S. Appl. No. 11/941,355, filed Nov. 16, 2007, Ikuno et al.
U.S. Appl. No. 12/000,239, filed Dec. 11, 2007, Fujiwara et al.
U.S. Appl. No. 12/035,016, filed Feb. 21, 2008, Iwamoto et al.
U.S. Appl. No. 12/047,011, filed Mar. 12, 2008, Kami et al.

* cited by examiner

ELECTROPHOTOGRAPHIC PHOTORECEPTOR, AND IMAGE FORMING METHOD, APPARATUS AND PROCESS CARTRIDGE THEREFOR USING THE PHOTORECEPTOR

CROSS-REFERENCE TO RELATED PATENT DOCUMENTS

This document claims priority and contains subject matter related to Japanese Patent Application No. 2003-329178 filed on Sep. 19, 2003, incorporated herein by reference.

BACKGROUND OF THE INVENTION

1. Field of the Invention

The present invention relates to an electrophotographic photoreceptor, and to an image forming method, an image forming apparatus and a process cartridge using the photoreceptor.

2. Discussion of the Background

Organic photoreceptors (OPCs) are widely used instead of inorganic photoreceptors for copiers, facsimiles, laser printers because of their superior performances and advantages. Specific advantages include (1) optical properties such as the ability to absorb a wide range of light and the ability to absorb a large amount of light; (2) electrical properties including high sensitivity and stable chargeability; (3) materials; (4) good manufacturability; (5) low cost; (6) non-toxicity, etc.

On the other hand, as image forming apparatuses become smaller so have photoreceptors Photoreceptors are also required to have good durability since recent image forming apparatuses produce images at a higher speeds and are free from maintenance. In this respect, the organic photoreceptor has a soft surface layer mainly formed from a low-molecular-weight charge transport material and an inactive polymer, and therefore the organic photoreceptor has a drawback of being mechanically abraded with an image developer and a cleaner when used repeatedly in the electrophotographic process. In addition, as toner particles have smaller particle diameters due to requirements for high-quality images, cleaning blades have greater rubber hardness and higher contact pressure to better clean the photoreceptor. Unfortunately, this also accelerates abrading photoreceptors. Such abrasions of photoreceptors deteriorate electrical properties such as sensitivities and chargeabilities, and cause abnormal images such as image density deterioration and background fouling. When a photoreceptor is locally abraded, images having black stripes due to defective cleaning are produced. At present, photoreceptors are exchanged because of these abrasions and damages.

Therefore, it is essential to decrease the abrasion amount of the organic photoreceptor to achieve greater durability. Further, it is desirable for the organic photoreceptor to have a low surface energy to prevent a toner from adhering thereto, and to have good cleanability and transferability.

As methods of improving the abrasion resistance of a photoreceptor, (1) Japanese Laid-Open Patent Publication No. 56-48637 discloses a photoreceptor using a hardening binder in its surface layer; (2) Japanese Laid-Open Patent Publication No. 64-1728 discloses a photoreceptor using charge transport polymer material; and (3) Japanese Laid-Open Patent Publication No. 4-281461 discloses a photoreceptor having a surface layer wherein an inorganic filler is dispersed.

The photoreceptor using a hardening binder of (1) increases residual potential and decreases image density because of poor solubility of the binder with a charge transport material and impurities such as a polymerization initiator and an unreacted residual group. The photoreceptor using charge transport polymer material of (2) and the photoreceptor having a surface layer wherein an inorganic filler is dispersed of (3) have abrasion resistance to some extent, but which is not fully satisfactory. Further, the photoreceptor having a surface layer wherein an inorganic filler is dispersed of (3) tends to increase a residual potential and decrease image density because of a trap on the surface of the inorganic filler. The photoreceptors of (1) to (3) do not have satisfactory electrical and mechanical durability.

To improve the abrasion and scratch resistance of the photoreceptor of (1), Japanese Patent No. 3262488 discloses a photoreceptor with a protection layer made of a hardened multifunctional acrylate monomer. When a low-molecular-weight charge transport material is simply included in a surface layer, the low-molecular-weight charge transport material is not soluble with the hardened multifunctional acrylate monomer and the low-molecular-weight charge transport material separates and becomes a cloud in the surface layer. This causes deterioration of mechanical strength of the photoreceptor. Further, since the hardened multifunctional acrylate monomer is reacted in a surface layer including a polymer binder, the monomer is not fully hardened. Thus, it is not soluble with the binder and fails to cause a surface concavity and convexity of the resultant photoreceptor due to the phase separation when hardened, resulting in defective cleanability.

Japanese Patent No. 3194392 discloses a method of forming a charge transport layer using a coating liquid formed from a monomer having a carbon-carbon double bond, a charge transport material having a carbon-carbon double bond and a binder resin. The binder resin includes a binder resin having a carbon-carbon double bond and a reactivity with the charge transport material, as well as a binder resin having neither a carbon-carbon double bond nor a reactivity with the charge transport material. When a binder resin does not react with a charge transport material, the binder resin is not soluble with a hardened material produced by a reaction between the monomer and charge transport material. This causes a surface concavity and convexity of the resultant photoreceptor due to the phase separation when crosslinked, resulting in defective cleanability. Further, the binder resin prevents the monomer from hardening, and the monomer used in the photoreceptor is a difunctional monomer which has few functional groups and does not have a sufficient crosslinked density. Therefore, the abrasion resistance of the resultant photoreceptor is not satisfactory. Even when a binder resin reacts with a charge transport material, since the monomer and binder resin have few functional groups, it is difficult to have both a bonding amount of the charge transport material and a crosslinked density. The resultant photoreceptor, therefore, does not have sufficient electrical properties and abrasion resistance.

Japanese Laid-Open Patent Publication No. 2000-66425 discloses a photosensitive layer including a hardened positive hole transport compound having two or more chain polymerizing functional groups in the same molecule.

However, since the photosensitive layer includes a bulky positive hole transport material having two or more chain polymerizing functional groups, a distortion appears in the hardened compound and internal stress increases to cause roughness and cracking in the surface layer, resulting in insufficient durability of the resultant photoreceptor.

On the other hand, Japanese Laid-Open Patent Publications Nos. 57-35863, 62-75641, 63-61256, 63-73267, 64-35448, 2-189550 and 11-344818 disclose methods of including a variety of lubricative additives in an outermost layer to decrease a surface energy of an organic photoreceptor for the purpose of imparting good cleanability and transferability. However, since these photoreceptors include a lubricant in the photosensitive layer having an insufficient abrasion resistance, adherence of various materials can be prevented in initial stages, but cannot be maintained for long periods.

Japanese Laid-Open Patent Publication No. 2000-310872 discloses a method of including a hardening acrylic compound and a reactive acrylic siloxane compound in a protective layer, and Japanese Laid-Open Patent Publication No. 2001-166510 discloses a method of including a saturated hydrocarbon compound as a lubricant in a hardened surface layer. The former uses a hardening compound without a charge transportable structure and uses an electroconductive particulate metal oxide to control resistivity of the protection layer. Therefore, deterioration of resistivity is inevitable due to a water-absorbing property of the electroconductive particulate metal oxide, and the photoreceptor produces blurred images. In the latter method, a lubricant, i.e., the hydrocarbon compound is chemically bonded with a matrix material in a hardened photosensitive layer and the lubricant is taken therein to prevent bleeding out and to maintain a low surface energy. However, since the photosensitive layer includes a bulky positive hole transport material having two or more chain polymerizing functional groups, a distortion appears in the hardened compound and the internal stress increases to cause roughness and cracking in the surface layer, resulting in poor durability. In addition, the distortion in the photosensitive layer enlarges concavity and convexity on the surface of the resultant photoreceptor, resulting in a smaller contact area between the photoreceptor and contact members. Therefore, the original low surface energy is not exerted.

Accordingly, even a conventional photoreceptor having a crosslinked photosensitive layer chemically bonded with a charge transportable structure fails to have sufficient overall characteristics. Although a variety of inventions to lower the surface energy have been made, these changes do not satisfactory improve the durability, electrical properties and other properties.

Because of these reasons, a need exists for an electrophotographic photoreceptor with good cleanability, high durability and stable electrical properties for long periods of time.

SUMMARY OF THE INVENTION

Accordingly, an object of the present invention is to provide an electrophotographic photoreceptor having good cleanability, high durability and stable electrical properties for long periods. The electrophotographic photoreceptor further includes a photosensitive layer having good surface smoothness, high abrasion resistance and good electrical properties.

Another object of the present invention is to provide an image forming method, an image forming apparatus and a process cartridge using the photoreceptor.

Briefly, these objects and other objects of the present invention are attained by an electrophotographic photoreceptor including an electroconductive substrate; and a photosensitive layer overlying the electroconductive substrate, wherein an outermost layer of the electrophotographic photoreceptor is a crosslinked layer comprising a radical polymerizing monomer having three or more functional groups without a charge transporting structure; a radical polymerizing compound having one functional group with a charge transporting structure; and a reactive silicone compound having a radical polymerizing functional group.

The radical polymerizing functional group of the reactive silicone compound is preferably an acryloyloxy group or a methacryloyloxy group.

The crosslinked layer preferably includes the reactive silicone compound in an amount of from 0.05 to 20% by weight based on total weight of the solid content of a coating liquid for forming the crosslinked layer.

The three or more functional groups of the radical polymerizing monomer not having a charge transporting structure are preferably from the acryloyloxy or methacryloyloxy groups.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout.

DETAILED DESCRIPTION OF THE INVENTION

Figure 1A:
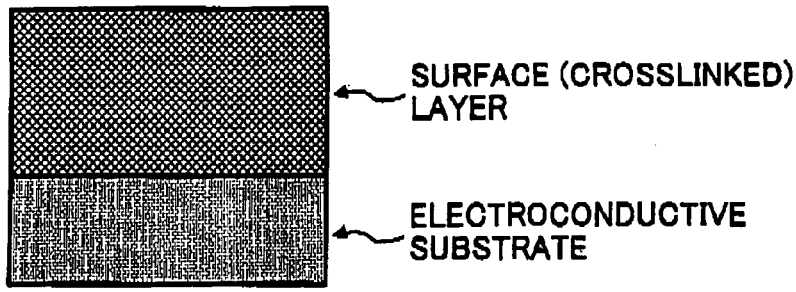
FIG. 1A and FIG. 1B are cross-sectional views of embodiments of layers of the electrophotographic photoreceptor of the present invention.

The present invention provides a photoreceptor having high abrasion resistance and good electrical properties, and which is capable of producing high-quality images for long periods of time.

The photoreceptor of the present invention includes a radical polymerizing monomer having three or more functional groups in the surface layer, which develops a three-dimensional network therein and a highly-hardened crosslinked surface layer having quite a high crosslinked density. This configuration results in a high abrasion resistance. When only radical polymerizing monomers having one and two functional groups are used, the crosslinked density is thin in the crosslinked layer and the resultant photoreceptor does not have a significant abrasion resistance. When the crosslinked surface layer includes a polymer material, development of the three-dimensional network is impaired and crosslinked density deteriorates, and therefore the resultant photoreceptor does not have sufficient abrasion resistance. Further, the polymer material is not soluble with a hardened material produced from a reaction of a radical polymerizing composition (a radical polymerizing monomer having three or more functional groups without a charge transporting structure, a radical polymerizing compound having one functional group with a charge transporting structure and a reactive silicone compound having a radical polymerizing functional group and a dimethyl siloxane structure as a repeat unit) and a local abrasion arises from a phase separation, resulting in a scratch on the surface of the resultant photoreceptor.

To form the crosslinked surface layer of the present invention, the radical polymerizing compound having one functional group with a charge transporting structure and reactive silicone compound having a radical polymerizing functional group and a dimethyl siloxane structure as a repeat unit are included in addition to the radical polymerizing monomer having three or more functional groups. These are hardened at the same time to form a crosslinking bond having a high hardness to improve the durability of the resultant photoreceptor. Further, since the crosslinked layer includes the radical polymerizing compound having one functional group with a charge transporting structure, the resultant photoreceptor has stable electrical properties for long periods.

On the contrary, when a low-molecular-weight charge transport material without a functional group is included in the crosslinked surface layer, the low-molecular-weight charge transport material separates and becomes clouded because of the low solubility. Resultantly, the mechanical strength of the crosslinked surface layer deteriorates. When a charge transport material having two or more functional groups are used, a distortion arises in a hardening resin because the charge transporting structure is bulky and an internal stress in the crosslinked surface layer increases. Therefore the resultant photoreceptor frequently has a crack and a scratch due to a carrier adherence. Further, since the charge transport material having two or more functional groups are fixed with plural bondings in the crosslinked structure, an intermediate structure (cation radical) cannot stably be maintained. This results in deterioration of sensitivity due to a charge trap and increase of residual potential. This deterioration of electrical properties results in degradation of image density and thinner character images.

To facilitate low surface energy of the photosensitive layer, an additive, i.e., a reactive silicone compound having a radical polymerizing functional group and a dimethyl siloxane structure as a repeat unit is included therein to be chemically bonded or polymerized with a crosslinked structure to be polymerized. Therefore, the crosslinked density increases, and durability of the crosslinked layer improves and the surface transferability of the additive to the surface is inhibited. In repeated use, the original properties of the silicon compound such as a high lubricity and a releasability, and toner adherence to the surface of a photoreceptor can be decreased and deterioration of a cleaner can be prevented. In long-term use, transferability and cleanability of a photoreceptor are noticeably improved, and image defects such as black stripes and black spots can be prevented. Therefore, an electrophotographic photoreceptor capable of producing high-quality images with an improved abrasion resistance is provided.

In the present invention resin forming the crosslinked layer is composed of compounds having a reactive functional group. Specifically, a radical polymerizing monomer having three or more functional groups without a charge transporting structure, a radical polymerizing compound having one functional group with a charge transporting structure, and a reactive silicone compound having a radical polymerizing functional group and a dimethyl siloxane structure as a repeat unit are mixed and polymerized to form a crosslinked surface layer. This results in improved abrasion resistance, stability of electrical properties for long periods and an improved continuousness of a low surface energy.

Next, constituents for a coating liquid for the crosslinked surface layer of the present invention will be explained.

The radical polymerizing monomer having three or more functional groups without a charge transporting structure for use in the present invention represents a monomer which does not have a positive hole transport structure such as triarylamine, hydrazone, pyrazoline and carbazole. The radical polymerization monomer also does not include an electron transport structure such as condensed polycyclic quinone, diphenoquinone, a cyano group and an electron attractive aromatic ring having a nitro group, and has three or more radical polymerizing functional groups. Any radical polymerizing functional groups can be used, provided they have a carbon-carbon double bonding and are capable of radically polymerizing. Specific examples of the radical polymerizing functional groups include the following 1-substituted ethylene functional groups and 1,1-substituted ethylene functional groups.

Specific examples of the 1-substituted ethylene functional groups include functional groups having the following formula (10):

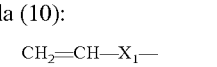

$$CH_2{=}CH{-}X_1{-} \quad (10)$$

$X_1$ represents a substituted or an unsubstituted phenylene group, an arylene group such as a naphthylene group, a substituted or an unsubstituted alkenylene group, a —CO-group, a —COO-group and a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group.

Specific examples of the substituents include vinyl groups, styryl groups, 2-methyl-1,3-butadienyl groups, vinylcarbonyl groups, acryloyloxy groups, acryloylamide groups, vinylthioether groups, etc.

Specific examples of the 1,1-substituted ethylene functional groups include functional groups having the following formula (11):

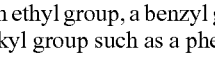

$$CH_2{=}CH(Y){-}X_2{-} \quad (11)$$

$Y_1$ represents a substituted or an unsubstituted alkyl group, a substituted or an unsubstituted aralkyl group, a substituted or an unsubstituted phenyl group, an aryl group such as a naphtyl group, a halogen atom, a cyano group, a nitro group, an alkoxy group such as a methoxy group or a ethoxy group and a —$COOR_{11}$ group. $R_{11}$ represents a hydrogen atom, a substituted or an unsubstituted methyl group, an alkyl group such as an ethyl group, a substituted or an unsubstituted benzyl group, an aralkyl group such as a phenethyl group, a substituted or an unsubstituted phenyl group and an aryl group such as a naphtyl group, or a —$CONR_{12}R_{13}$ wherein $R_{12}$ and $R_{13}$ independently represent a hydrogen atom, a substituted or an unsubstituted methyl group, an alkyl group such as an ethyl group, a substituted or an unsubstituted benzyl group, a naphthylmethyl group, an aralkyl group such as a phenethyl group, a substituted or an unsubstituted phenyl group and an aryl group such as a naphtyl group. $X_2$ represents a substituted or an unsubstituted phenylene group, an arylene group such as a naphthylene group, a substituted or an unsubstituted alkenylene group, a —CO-group, a —COO-group, a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group; and at least either Y or $X_2$ is an oxycarbonyl group.

Specific examples of the substituents include α-acryloyloxy chloride groups, methacryloyloxy groups, α-cyanoethylene groups, α-cyanoacryloyloxy groups, α-cyanophenylene groups, methacryloylamino groups, etc.

Specific examples of further substituents for the substituents of $X_1$, $X_2$ and Y include halogen atoms, nitro groups, cyano groups, methyl groups, alkyl groups such as ethyl groups, methoxy groups, alkoxy groups such as ethoxy groups, aryloxy groups such as phenoxy groups, phenyl groups, aryl groups such as naphthyl groups, benzyl groups, aralkyl groups such as phenethyl groups.

Among these radical polymerizing function groups, the acryloyloxy groups and methacryloyloxy groups are effectively used. A compound having three or more acryloyloxy groups can be formed by, e.g., performing an ester reaction or an ester exchange reaction among a compound having three or more hydroxyl groups, an acrylic acid (salt), halide acrylate and ester acrylate. A compound having three or more methacryloyloxy groups can be formed by the same method. The radical polymerizing function groups in a monomer having three or more radical polymerizing function groups may be the same or different from one another.

Specific examples of the radical polymerizing monomer having three or more functional groups without a charge transporting structure include the following materials, but are not limited thereto.

Namely, trimethylolpropanetriacrylate (TMPTA), trimethylolpropanetrimethacrylate, HPA-modified trimethylolpropanetriacrylate, EO-modified trimethylolpropanetriacrylate, PO-modified trimethylolpropanetriacrylate, caprolactone-modified trimethylolpropanetriacrylate, HPA-modified trimethylolpropanetrimethacrylate, pentaerythritoltriacrylate, pentaerythritoltetraacrylate (PETTA), glyceroltriacrylate, ECH-modified glyceroltriacrylate, EO-modified glyceroltriacrylate, PO-modified glyceroltriacrylate, tris(acryloxyethyl)isocyanurate, dipentaerythritolhexaacrylate (DPHA), caprolactone-modified dipentaerythritolhexaacrylate, dipentaerythritolhydroxypentaacrylate, alkyl-modified dipentaerythritolpentaacrylate, alkyl-modified dipentaerythritoltetraacrylate, alkyl-modified dipentaerythritoltriacrylate, dimethylolpropanetetraacrylate (DTMPTA), pentaerythritolethoxytetraacrylate, 2,2,5,5-tetrahydroxymethylcyclopentanonetetraacrylate, etc. are available. These can be used alone or in combination.

The radical polymerizing monomer having three or more functional groups without a charge transporting structure for use in the present invention preferably has a ratio of the molecular weight to the number of functional groups (molecular weight/number of functional groups) not greater than 250. When the ratio is greater than 250, the resultant crosslinked surface layer has a lowered abrasion resistance, and it is not preferable to use the HPA, EO and PO-modified monomers having long modified groups.

The crosslinked surface layer preferably includes the radical polymerizing monomer having three or more functional groups without a charge transporting structure in an amount of from 20 to 80% by weight, and more preferably from 30 to 70% by weight. When less than 20% by weight, a three-dimensional crosslinked bonding density of the crosslinked surface layer is insufficient and the abrasion resistance does not remarkably improve more than a layer including a conventional thermoplastic resin. When greater than 80% by weight, the content of a charge transporting compound lowers and electrical properties of the resultant photoreceptor deteriorates. Although it depends on the balance required between abrasion resistance and electrical properties, the content of the radical polymerizing monomer having three or more functional groups without a charge transporting structure is most preferably from 30 to 70% by weight based on total weight of the crosslinked surface layer.

The radical polymerizing compound having one functional group with a charge transporting structure for use in the present invention is a compound which has a positive hole transport structure such as triarylamine, hydrazone, pyrazoline and carbazole or an electron transport structure such as condensed polycyclic quinone, diphenoquinone, a cyano group and an electron attractive aromatic ring having a nitro group, and has a radical polymerizing functional group. Specific examples of the radical polymerizing functional group include the above-mentioned radical polymerizing monomers, and particularly the acryloyloxy groups and methacryloyloxy groups. In addition, a triarylamine structure is effectively used as the charge transport structure. Further, when a compound having the following formula (1) or (2) is used, electrical properties such as a sensitivity and a residual potential are preferably maintained.

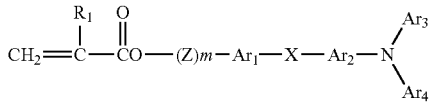

(1)

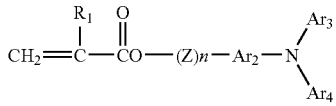

(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n represent 0 and an integer of from 1 to 3, respectively.

In the formulae (1) and (2), among substituted groups of $R_1$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc.

These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups.

The substituted group of $R_1$, is preferably a hydrogen atom and a methyl group.

$Ar_3$ and $Ar_4$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group preferably includes a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group.

Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condnesed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene and oxadiazole.

Specific examples of the substituted or unsubstituted aryl group represented by Ar3 and Ar4 include the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include methoxy groups, ethoxy groups, n-propoxy groups, I-propoxy groups, t-butoxy groups, s-butoxy groups, I-butoxy groups, 2-hydroxyethoxy groups, benzyloxy groups, trifluoromethoxy groups, etc.

(4) aryloxy groups, and specific examples of the aryl groups include phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

(6)

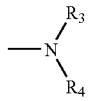

wherein $R_3$ and $R_4$ independently represent a hydrogen atom, an alkyl groups specified in (2) and an aryl group, and specific examples of the aryl groups include phenyl groups, biphenyl groups and naphthyl groups, and these may include an alkoxy group having 1 to 4 carbon atoms, an alkyl group having 1 to 4 carbon atoms or a halogen atom as a substituent, and $R_3$ and $R_4$ may form a ring together. Specific examples of the groups having this formula include amino groups, diethylamino groups, N-methyl-N-phenylamino groups, N,N-diphenylamino groups, N-N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc.

The arylene group represented by $Ar_1$ and $Ar_2$ are derivative divalent groups from the aryl groups represented by $Ar_3$ and $Ar_4$.

The above-mentioned X represents a single bond, a substituted or an unsubstituted alkylene group, a substituted or an unsubstituted cycloalkylene group, a substituted or an unsubstituted alkyleneether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples include cyclohexylidine groups, cyclohexylene groups and 3,3-dimethylcyclohexylidine groups, etc.

Specific examples of the substituted or unsubstituted alkyleneether groups include —$CH_2CH_2O$-groups, —$CH_2CH_2CH_2O$-groups, $(OCH_2CH_2)_h$—O-groups, —$(OCH_2CH_2CH_2$—O-groups, etc., wherein h and i independently represent an integer of from 1 to 4.

The alkylene group of the alkyleneether group may include a substituent such as a hydroxyl group, a methyl group and an ethyl group.

The vinylene group has the following formula:

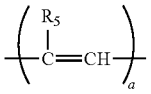

or

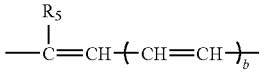

In the compound above, R5 represents a hydrogen atom, an alkyl group (same as those specified in (2)), an aryl group (same as those represented by $Ar_3$ and $Ar_4$); a represents 1 or 2; and b represents 1, 2 or 3. Z represents a substituted or an unsubstituted alkylene group, a substituted or an unsubstituted alkyleneether group and alkyleneoxycarbonyl group. Specific examples of the substituted or unsubstituted alkylene group include those of X. Specific examples of the substituted or unsubstituted alkyleneether group include those of X. Specific examples of the alkyleneoxycarbonyl group include caprolactone-modified groups.

In addition, the radical polymerizing compound having one functional group with a charge transporting structure of the present invention is more preferably a compound having the following formula (3):

Namely, the radical polymerizing compound having one functional group with a charge transporting structure of the formulae (1), (2) and particularly (3) for use in the present invention is built in a chain polymer and does not become an end structure because a double bonding between the carbons is polymerized while opened to the both sides. In a crosslinked polymer polymerized with a radical polymerizing monomer having three or more functional groups, the compound is present in a main chain and in a crosslinked chain between the main chains (the crosslinked chain includes an intermolecular crosslinked chain between a polymer and another polymer and an intramolecular crosslinked chain wherein a portion having a folded main chain and another portion originally from the monomer, which is polymerized with a position apart therefrom in the main chain are polymerized). Even when the compound is present in a main chain or a crosslinked chain, a triarylamine structure suspending from the chain has at least three aryl groups radially located from a nitrogen atom, it is not directly bonded with the chain and suspends through a carbonyl group or the like. This becomes sterically and flexibly fixed, although bulky. The triarylamine structures can spatially be located so as to be moderately adjacent to one another in a polymer, and have less structural distortion in a molecule. Therefore, the radical polymerizing compound having one functional group with a charge transporting structure in a surface layer of an electrophotographic photoreceptor can have an intramolecular structure to prevent blocking of a charge transport route.

(3)

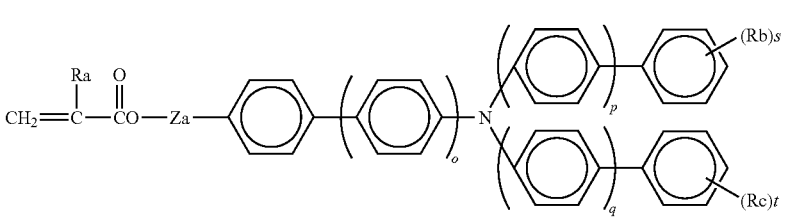

In the compound above, o, p and q independently represent 0 or 1; Ra represents a hydrogen atom or a methyl group; Rb and Rc represents a substituent besides a hydrogen atom and an alkyl group having 1 to 6 carbon atoms, and may be different from each other when having plural carbon atoms; s and t represent 0 or an integer of from 1 to 3; Za represents a single bond, a methylene group, ethylene group,

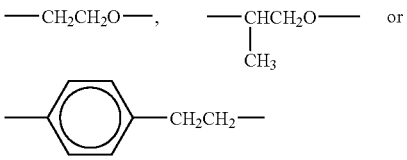

The compound having formula (3) are preferably a compound having an methyl group or a ethyl group as a substituent of Rb and Rc.

The cross-linked surface layer formed in the present invention is crack resistant and has superior electrical properties.

Specific examples of the radical polymerizing compound having one functional group with a charge transporting structure include compounds having the following formulae, but the compounds are not limited thereto.

TABLE 1-1

No. 1

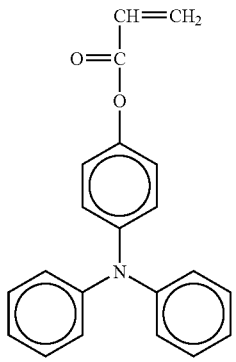

TABLE 1-1-continued
No. 2
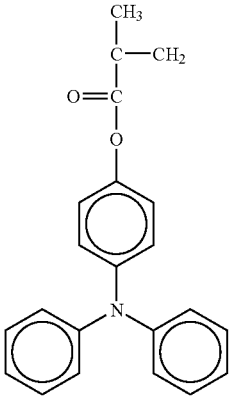
No. 3
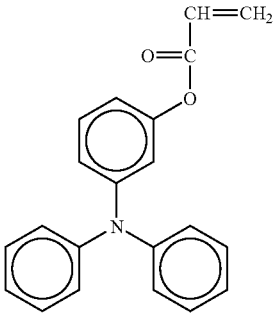
No. 4
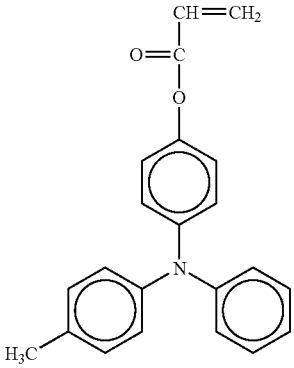
No. 5
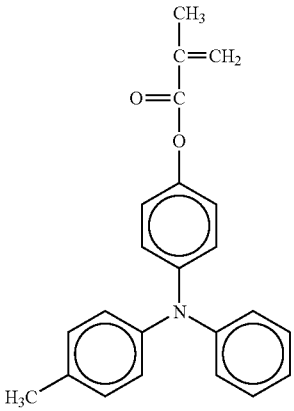
TABLE 1-1-continued
No. 6
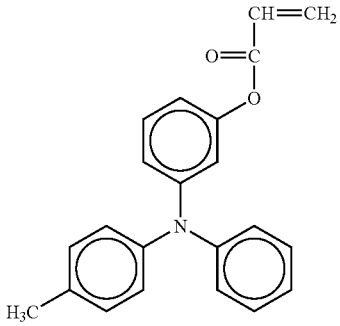
No. 7
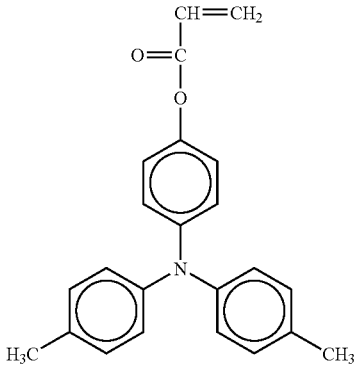
No. 8
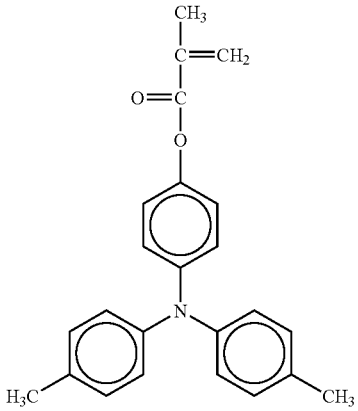
No. 9
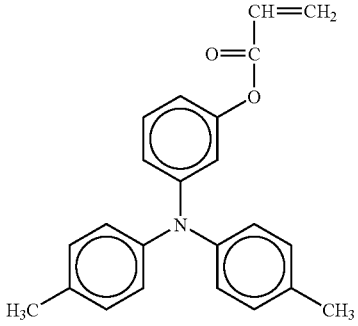

TABLE 1-1-continued
No. 10
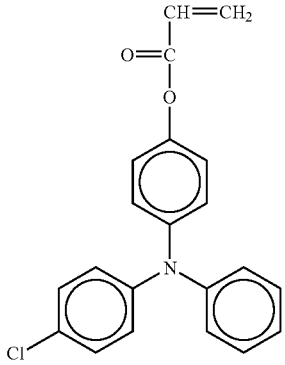
No. 11
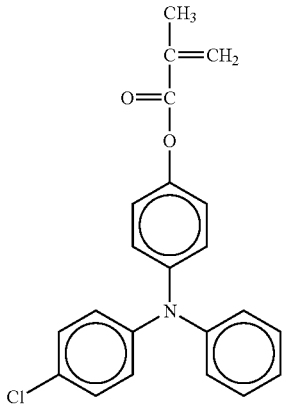
No. 12
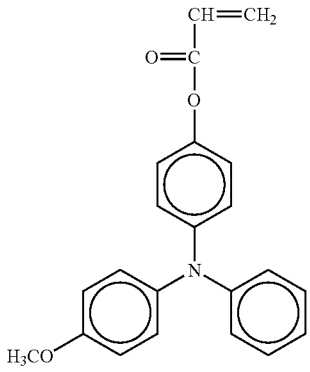
TABLE 1-1-continued
No. 13
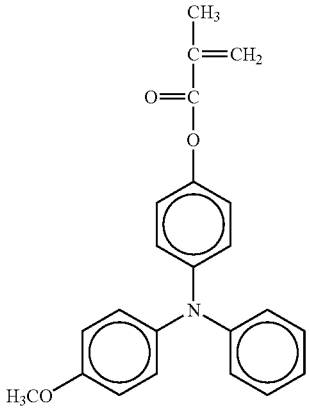
No. 14
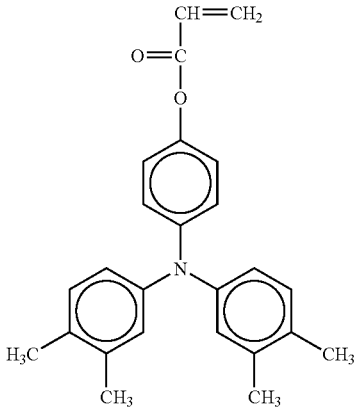
No. 15
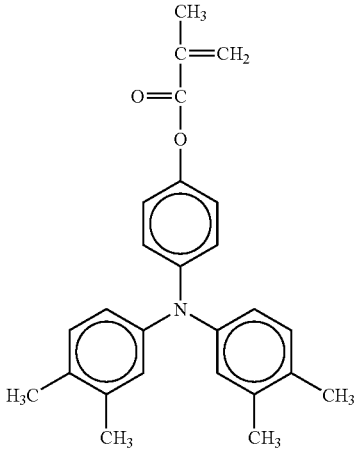

TABLE 1-1-continued
No. 16
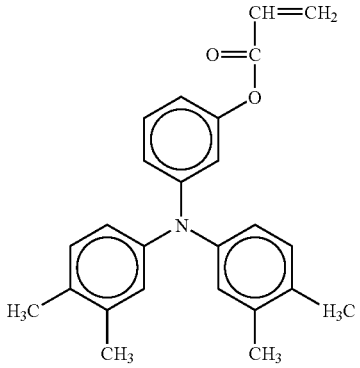
TABLE 1-2
No. 17
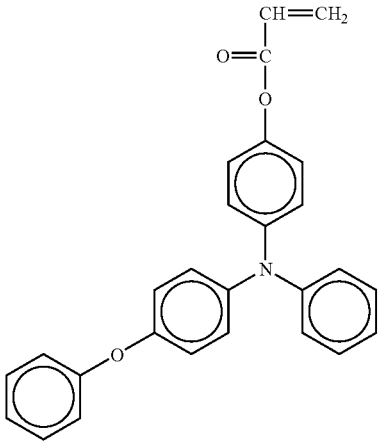
No. 18
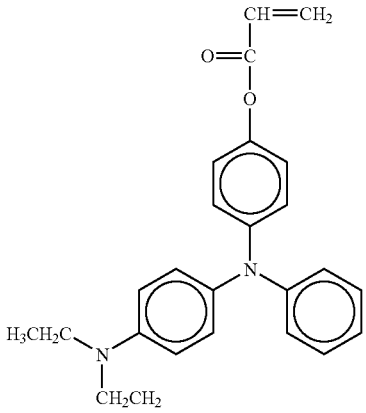
TABLE 1-2-continued
No. 19
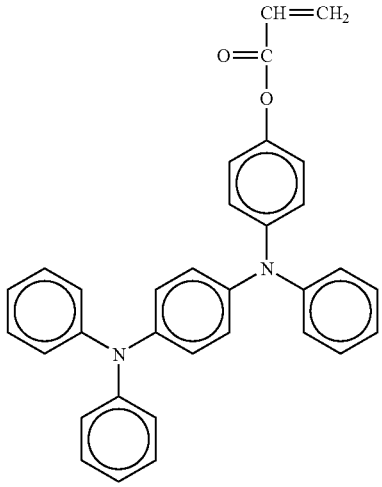
No. 20
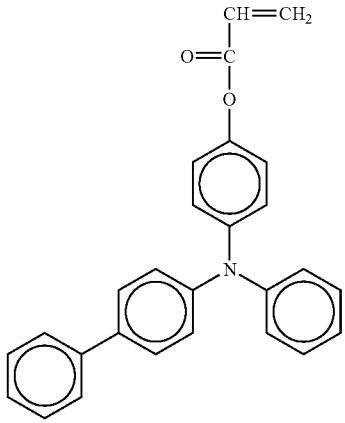
No. 21
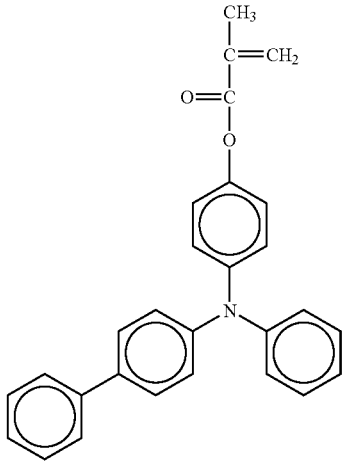

TABLE 1-2-continued
No. 22
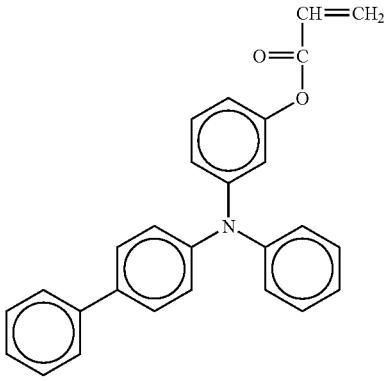
No. 23
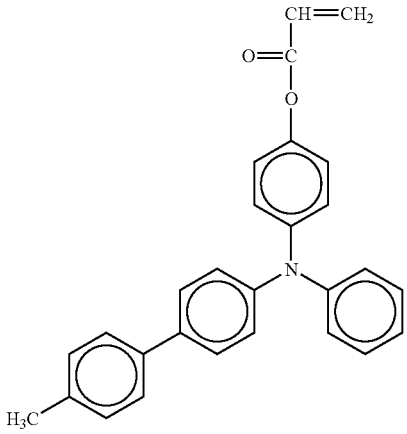
No. 24
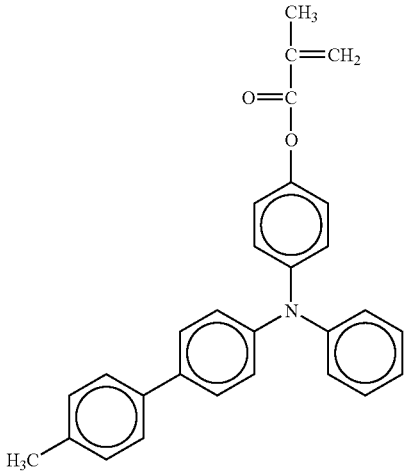
TABLE 1-2-continued
No. 25
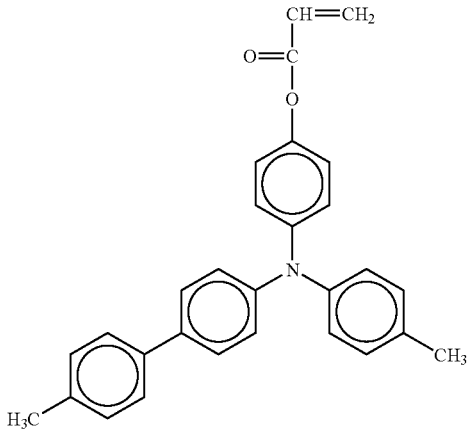
No. 26
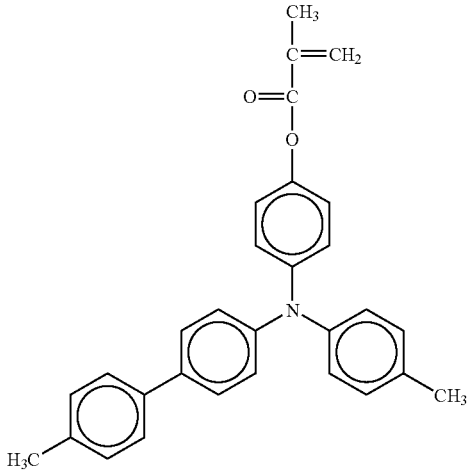
No. 27
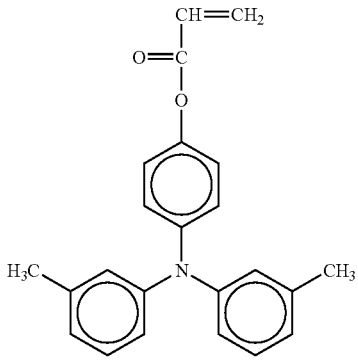

TABLE 1-2-continued
No. 28
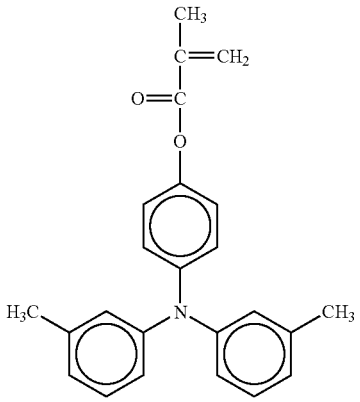
No. 29
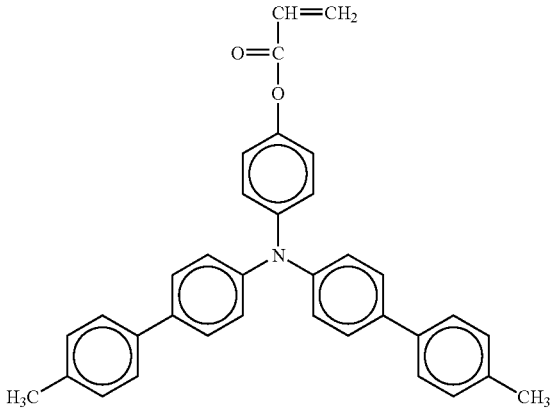
No. 30
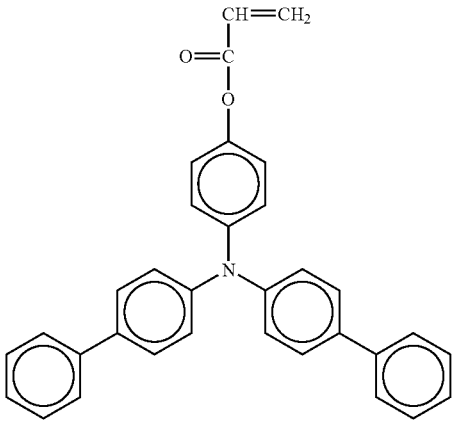
TABLE 1-2-continued
No. 31
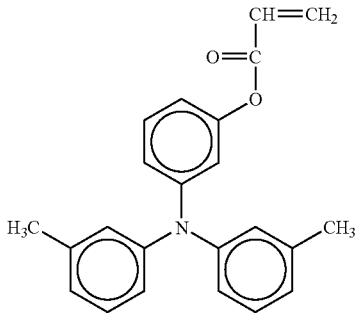
No. 32
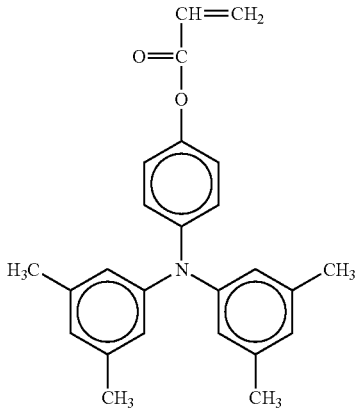
TABLE 1-3
No. 33
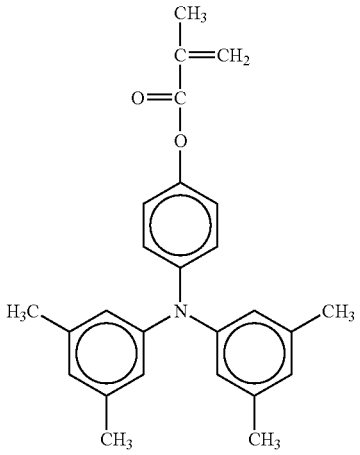

TABLE 1-3-continued
No. 34
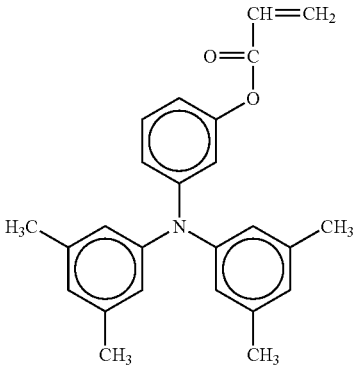
No. 35
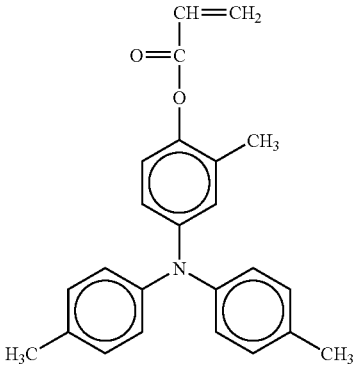
No. 36
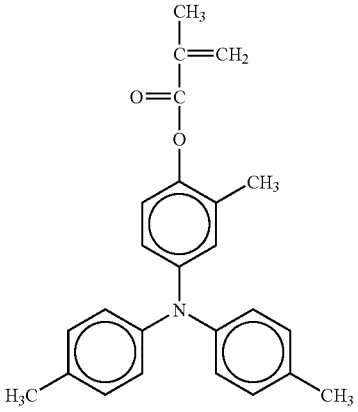
TABLE 1-3-continued
No. 37
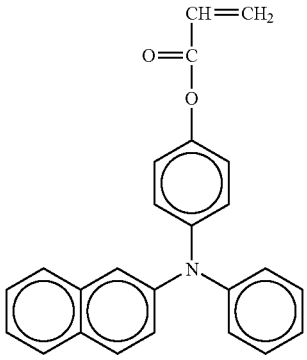
No. 38
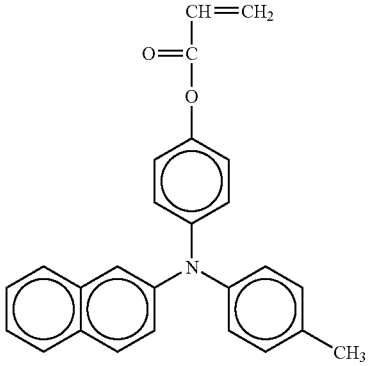
No. 39
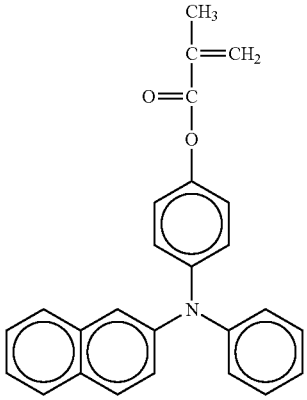
No. 40
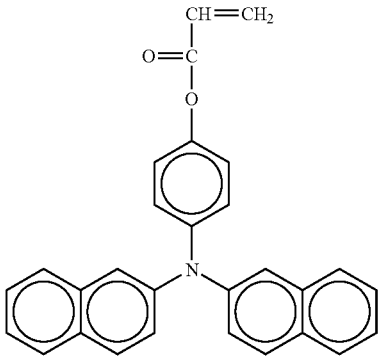

TABLE 1-3-continued
No. 41
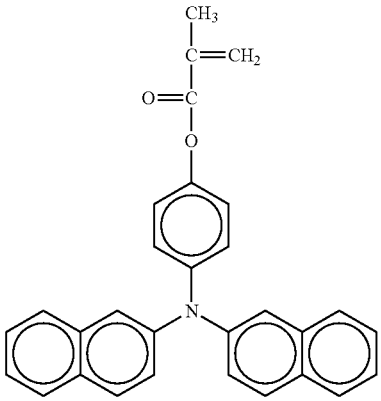
No. 42
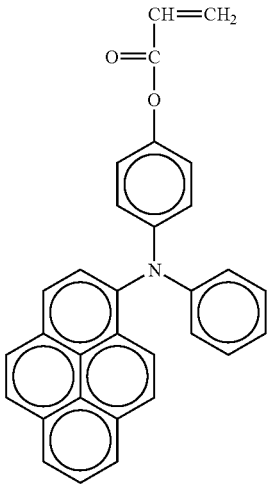
No. 43
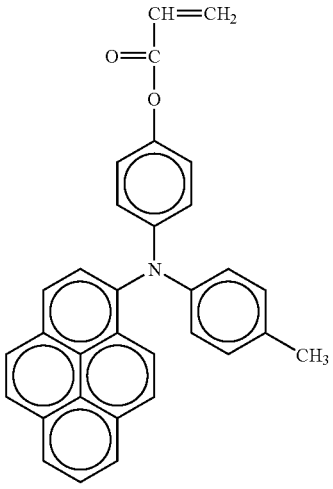
TABLE 1-3-continued
No. 44
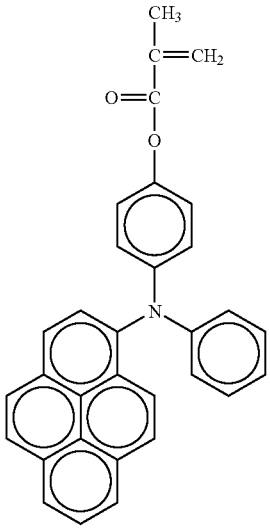
No. 45
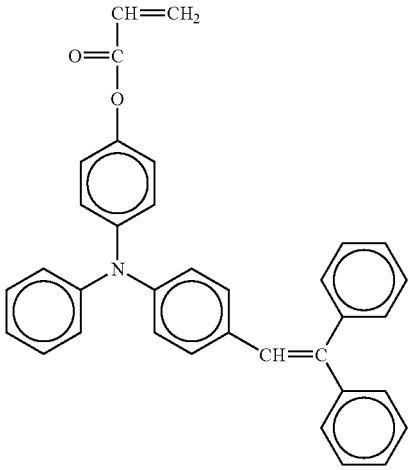
No. 46
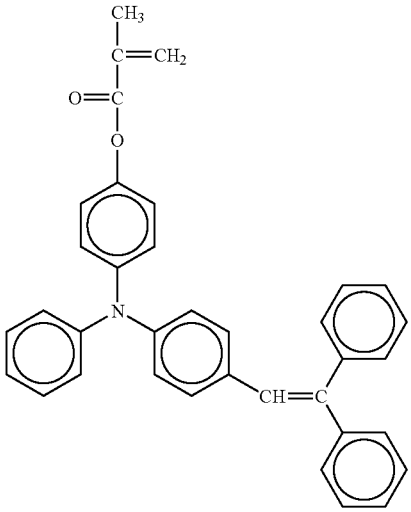

TABLE 1-3-continued
No. 47
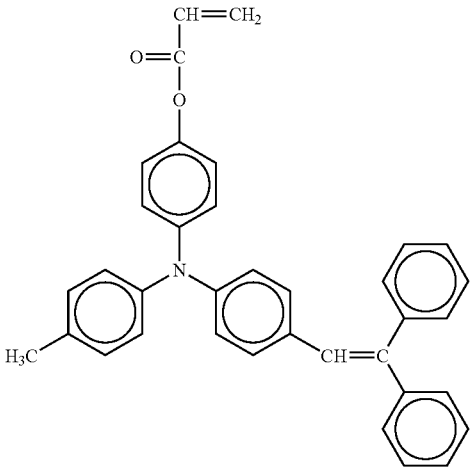
No. 48
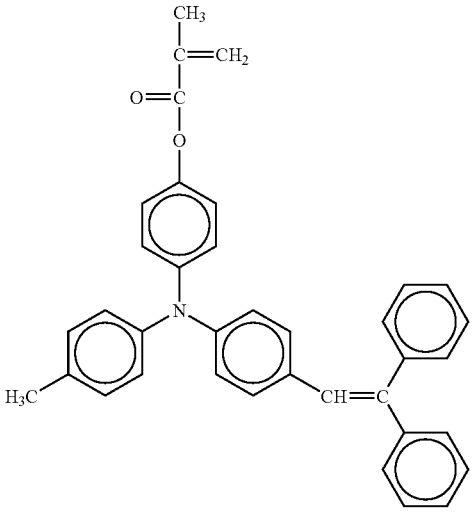
TABLE 1-4
No. 49
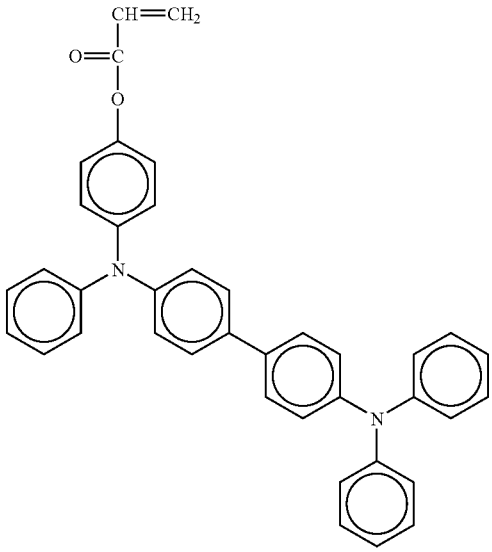
No. 50
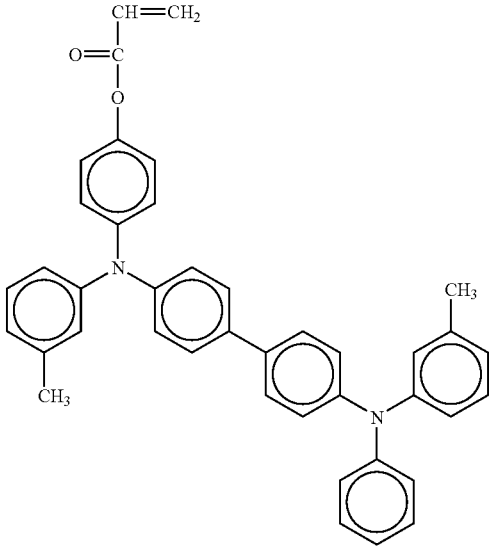

TABLE 1-4-continued
No. 51
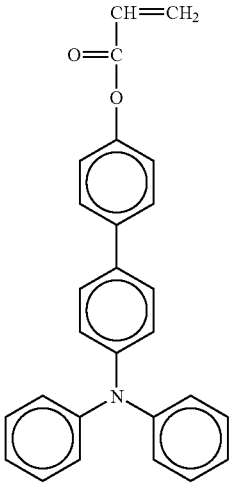
No. 52
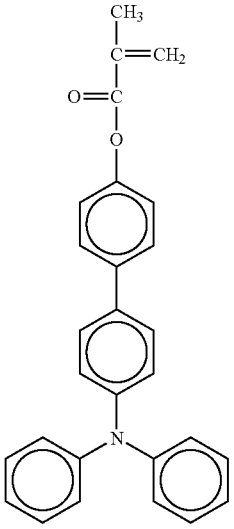
No. 53
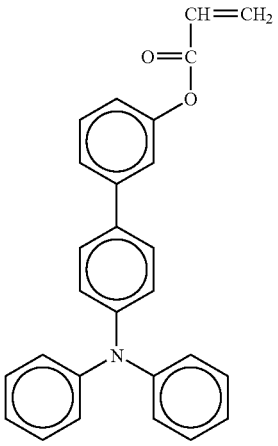
TABLE 1-4-continued
No. 54
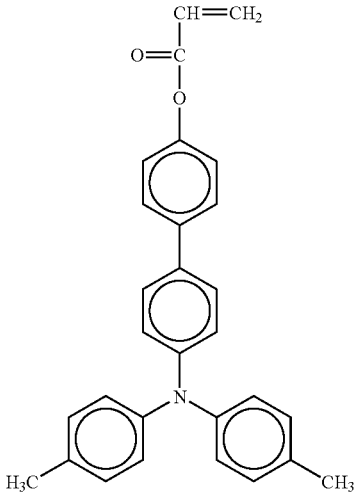
No. 55
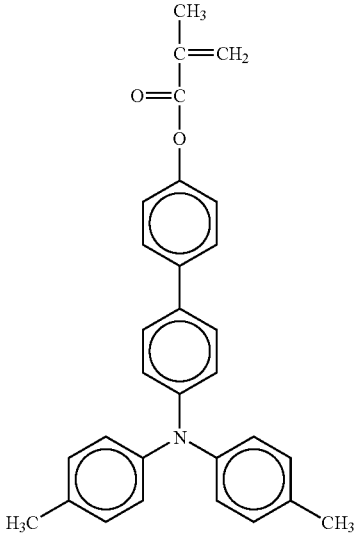
No. 56
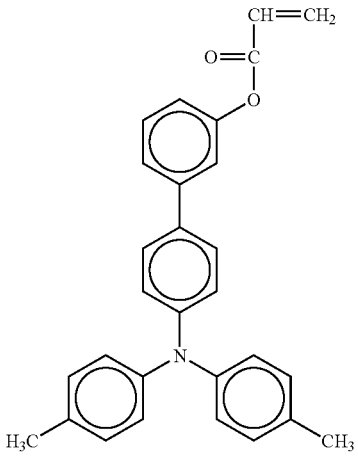

TABLE 1-4-continued
No. 57
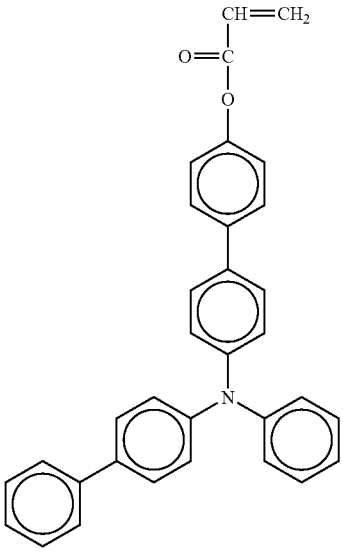
No. 58
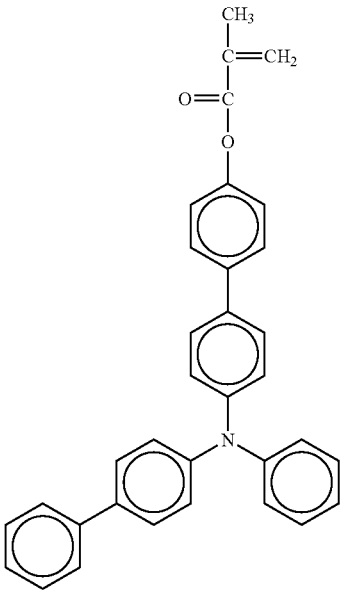
TABLE 1-4-continued
No. 59
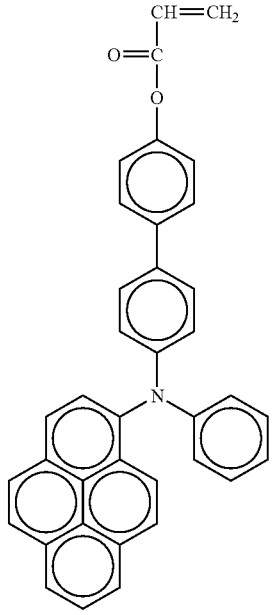
No. 60
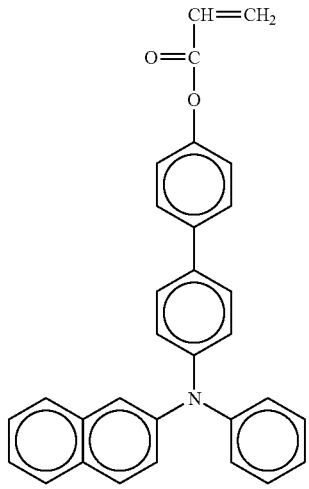

TABLE 1-5
No. 61
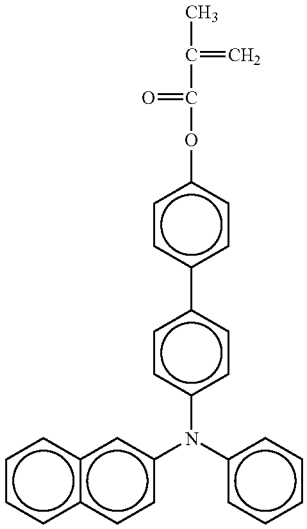
No. 62
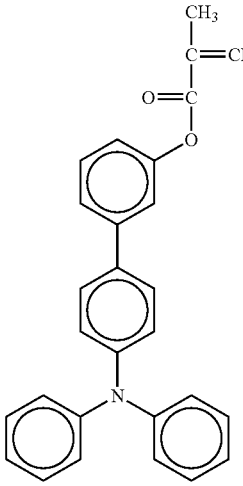
No. 63
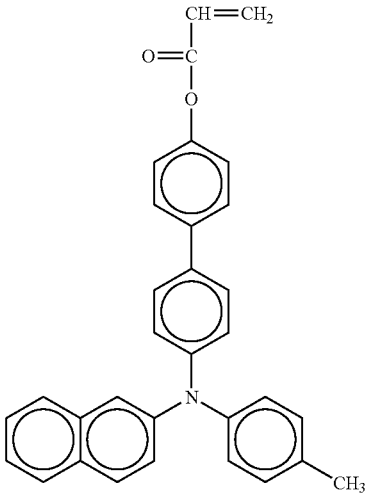
TABLE 1-5-continued
No. 64
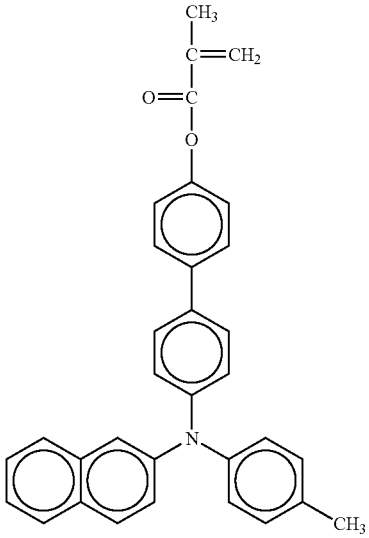
No. 65
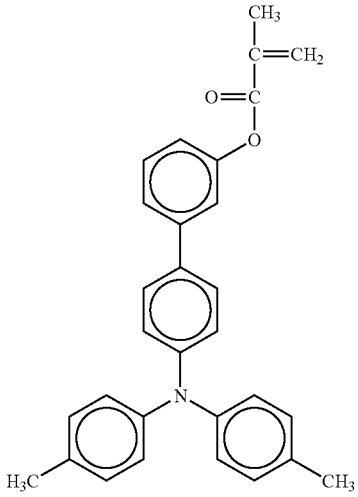

TABLE 1-5-continued
No. 66
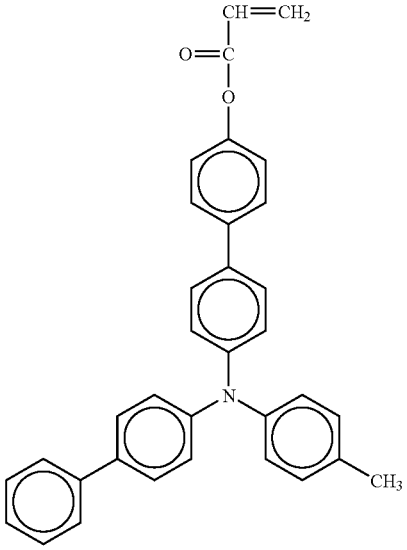
No. 67
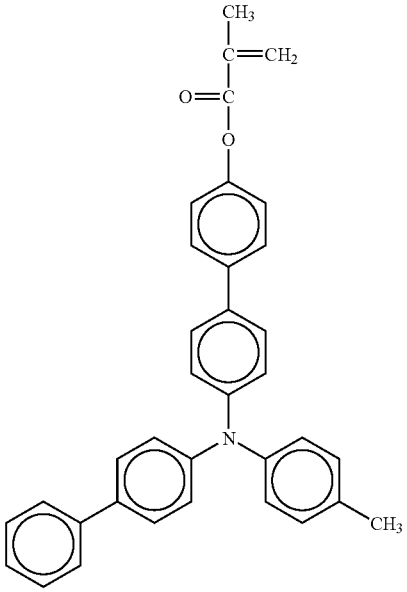
TABLE 1-5-continued
No. 68
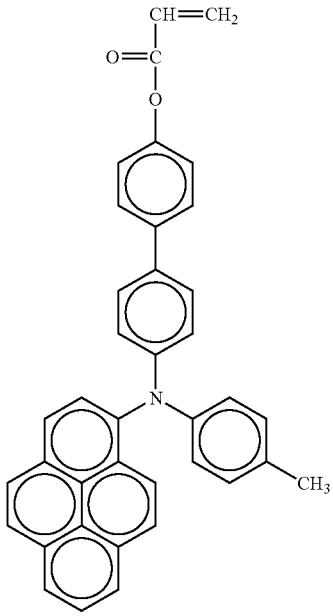
No. 69
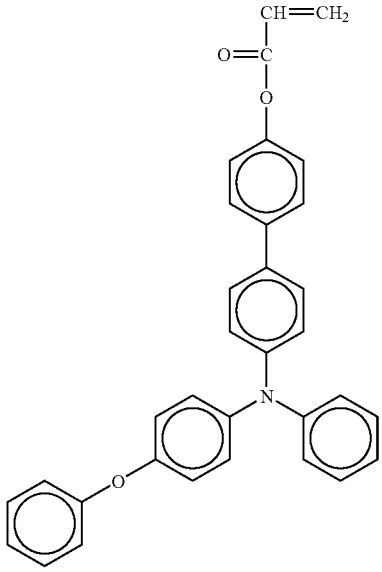

TABLE 1-5-continued
No. 70
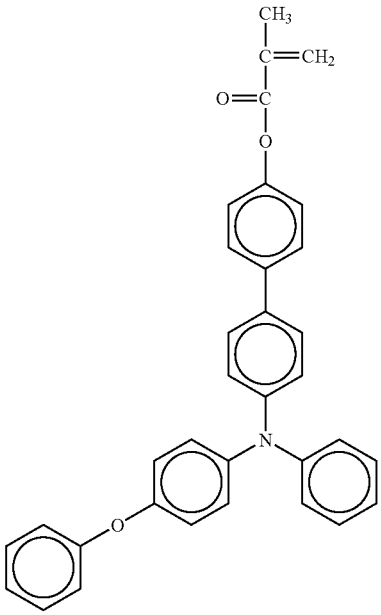
No. 71
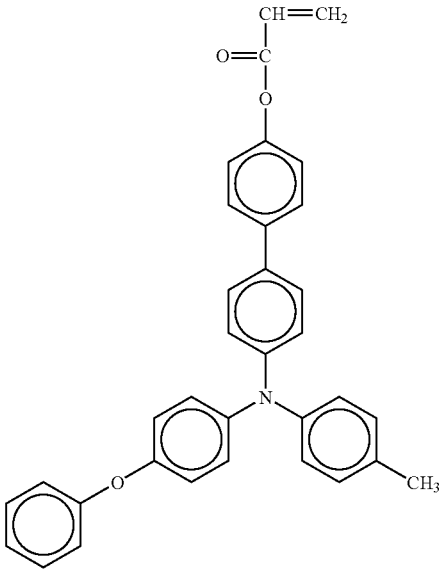
TABLE 1-5-continued
No. 72
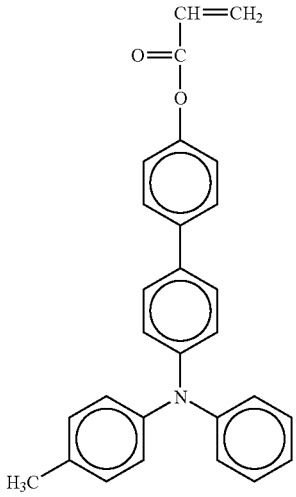
TABLE 1-6
No. 73
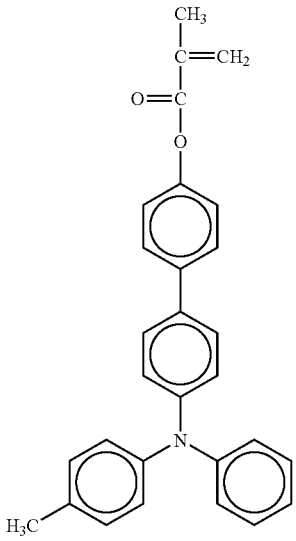

TABLE 1-6-continued
No. 74
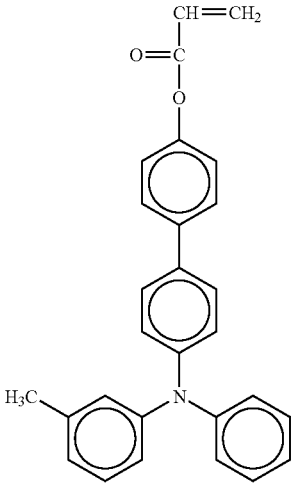
No. 75
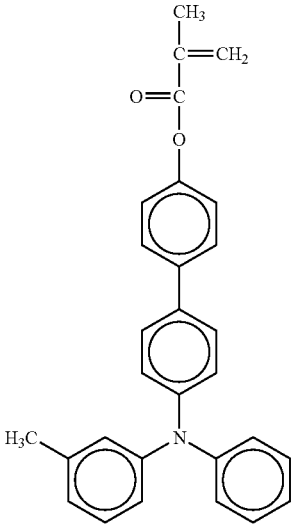
No. 76
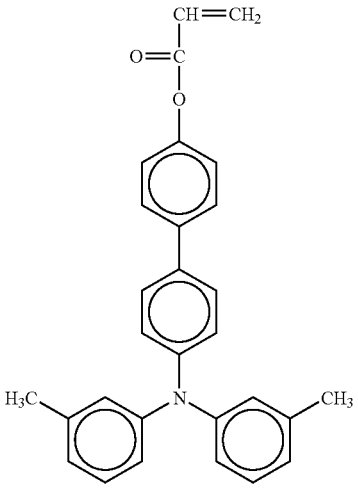
TABLE 1-6-continued
No. 77
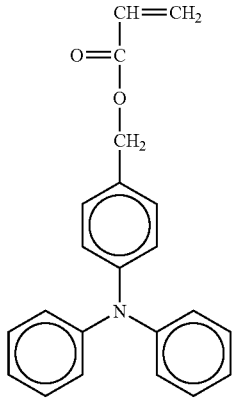
No. 78
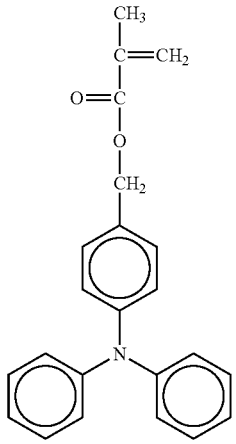
No. 79
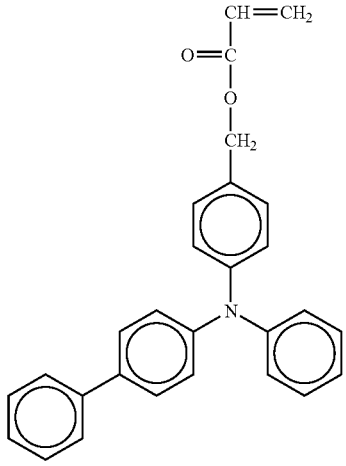

TABLE 1-6-continued
No. 80
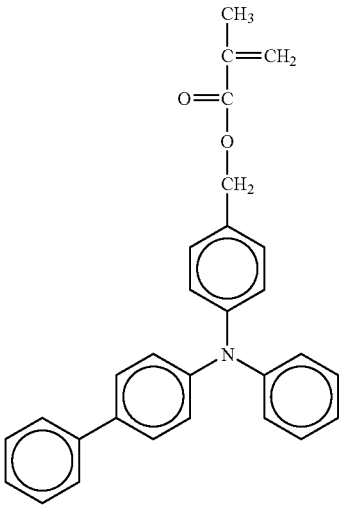
No. 81
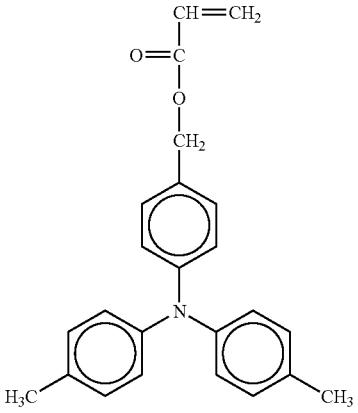
No. 82
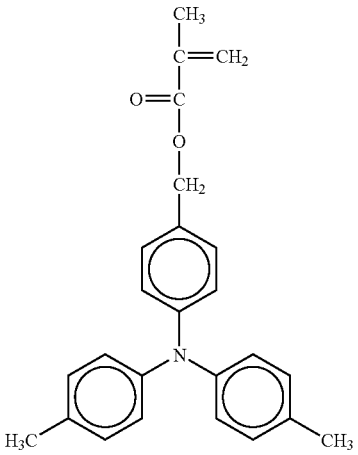
TABLE 1-6-continued
No. 83
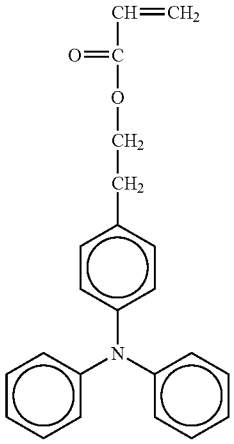
No. 84
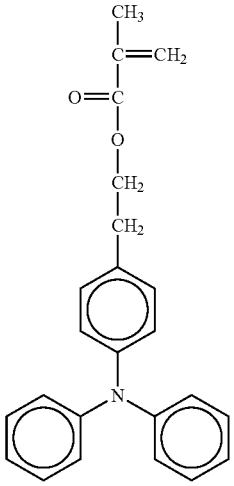
No. 85
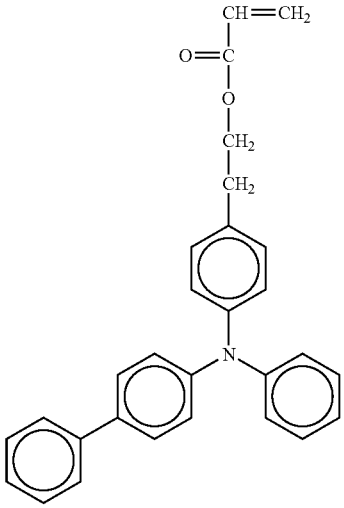

TABLE 1-6-continued
No. 86
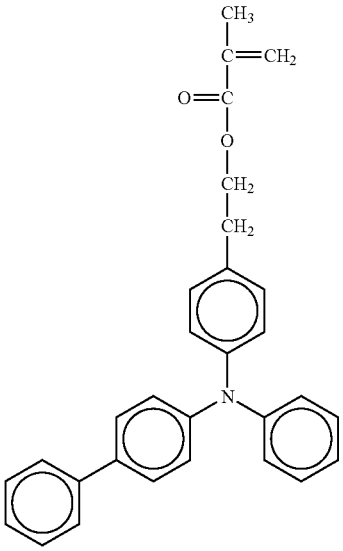
No. 87
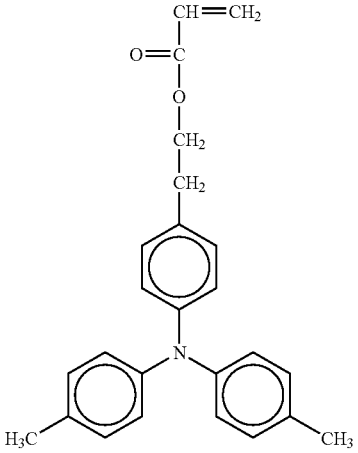
No. 88
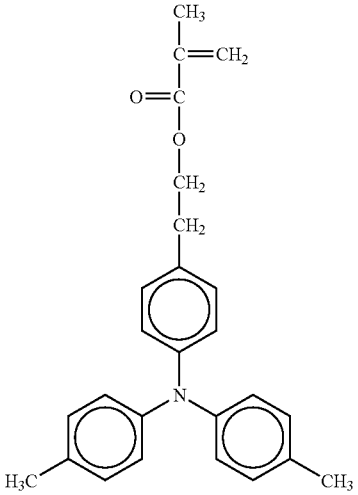
TABLE 1-7
No. 89
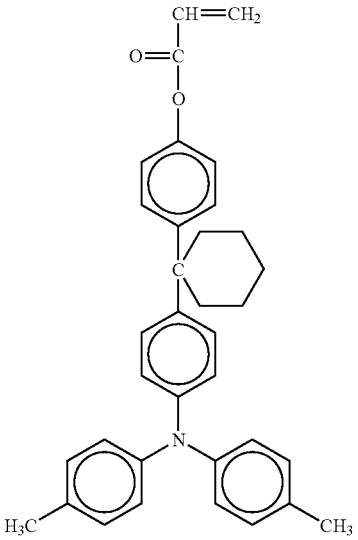
No. 90
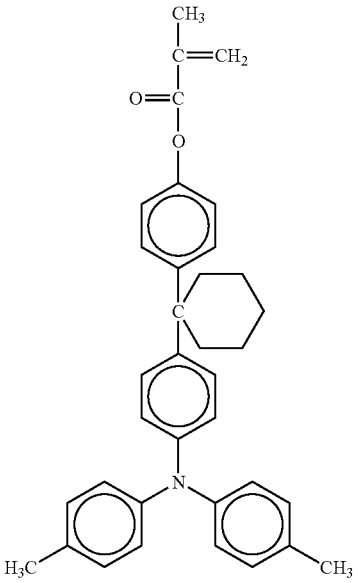

TABLE 1-7-continued
No. 91
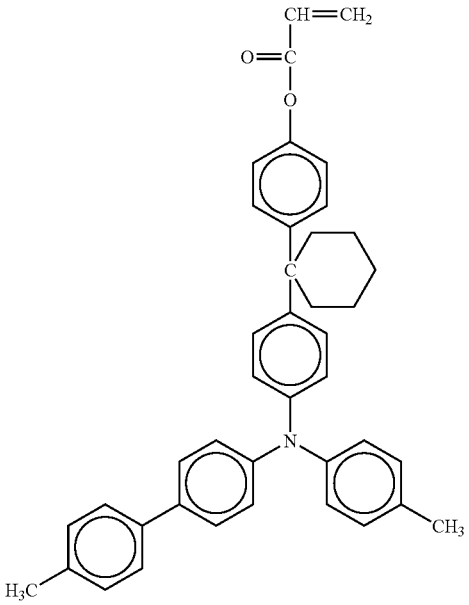
No. 92
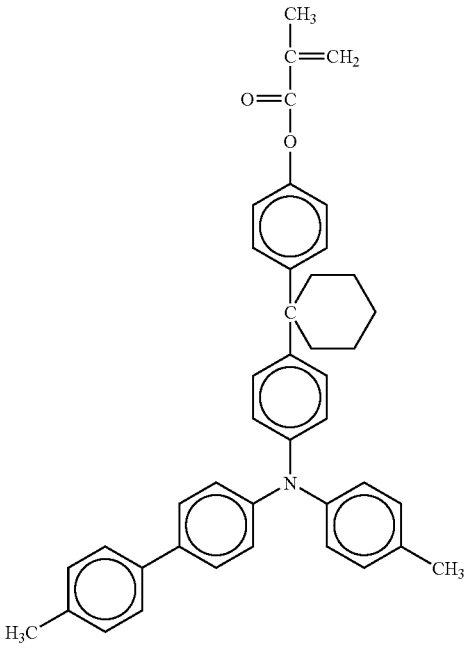
TABLE 1-7-continued
No. 93
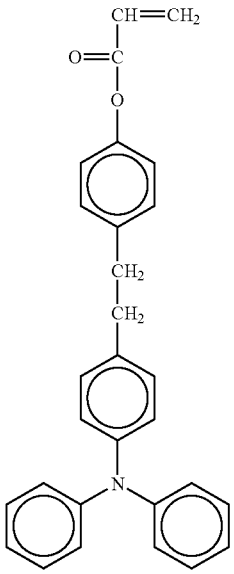
No. 94
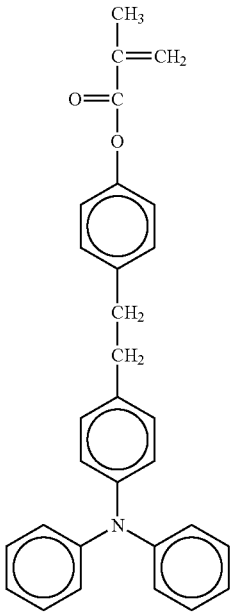

TABLE 1-7-continued
No. 95
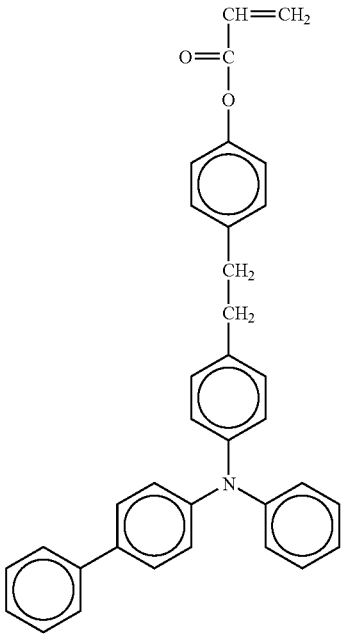
No. 96
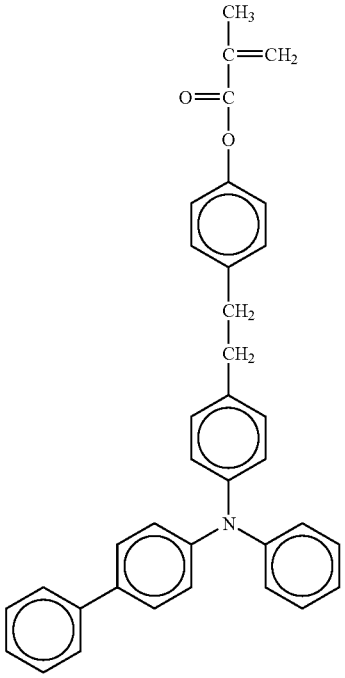
TABLE 1-7-continued
No. 97
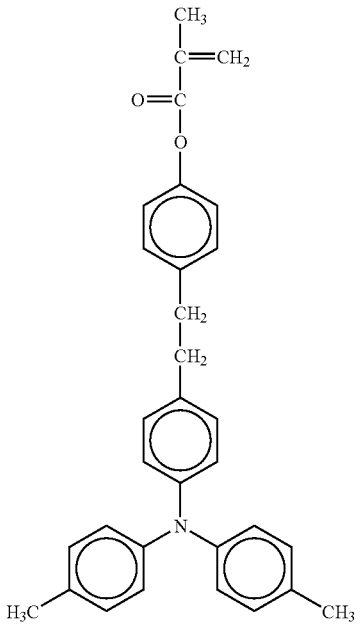
No. 98
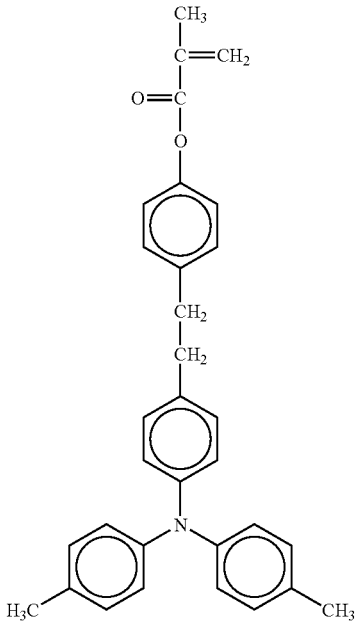

TABLE 1-7-continued
No. 99
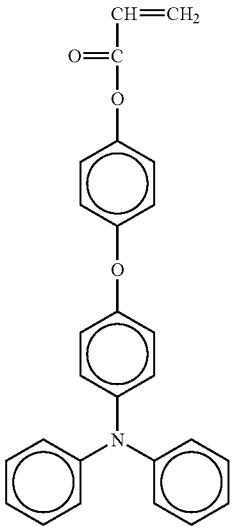
No. 100
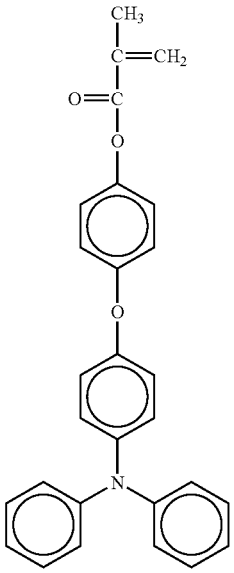
TABLE 1-8
No. 101
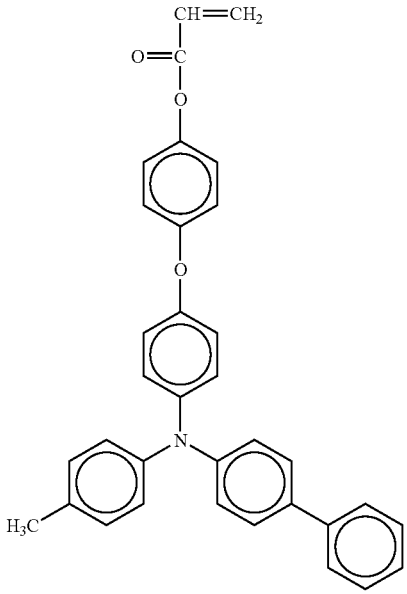
No. 102
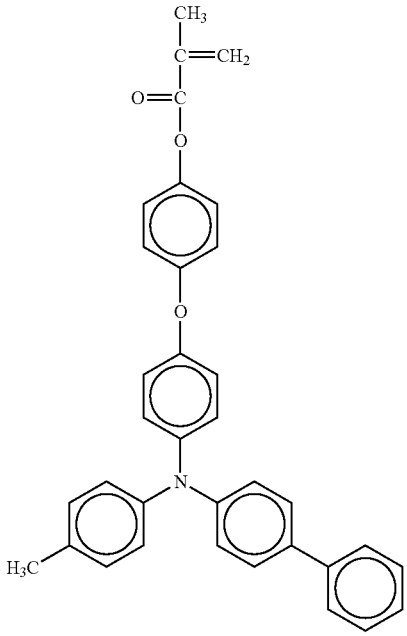

TABLE 1-8-continued
No. 103
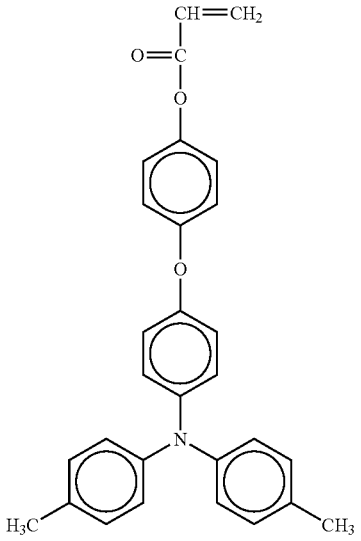
No. 104
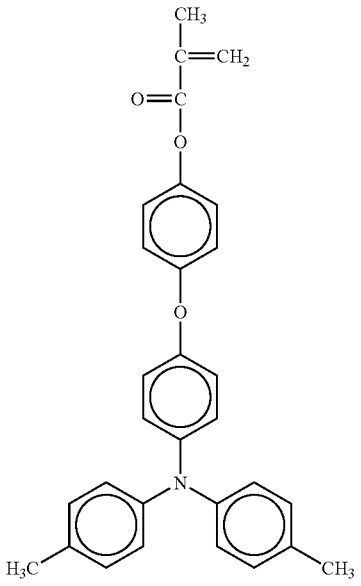
TABLE 1-8-continued
No. 105
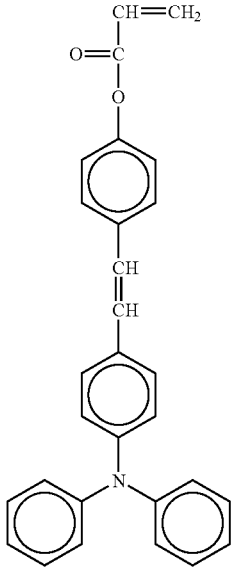
No. 106
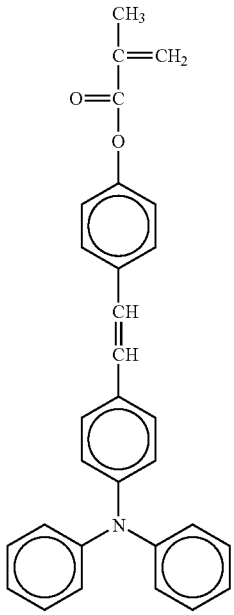

TABLE 1-8-continued
No. 107
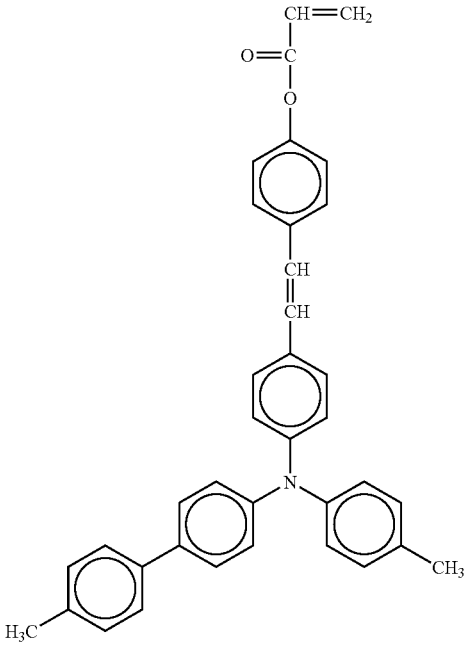
No. 108
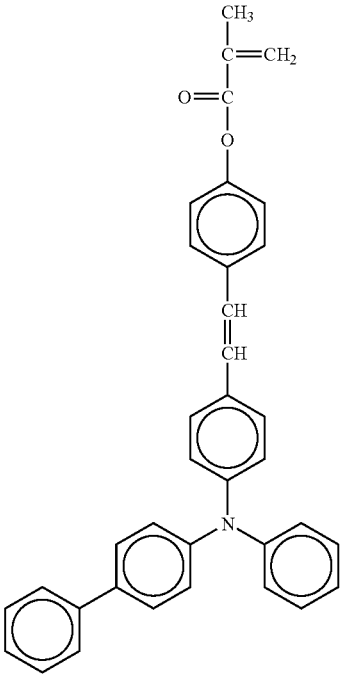
TABLE 1-8-continued
No. 109
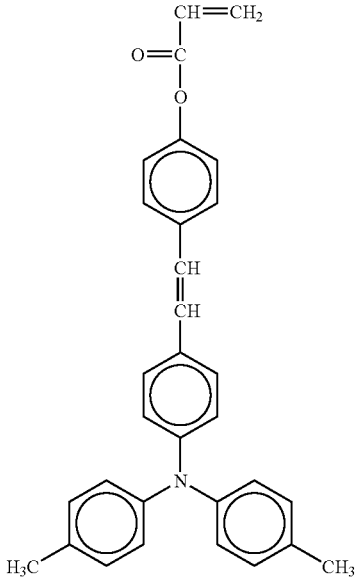
No. 110
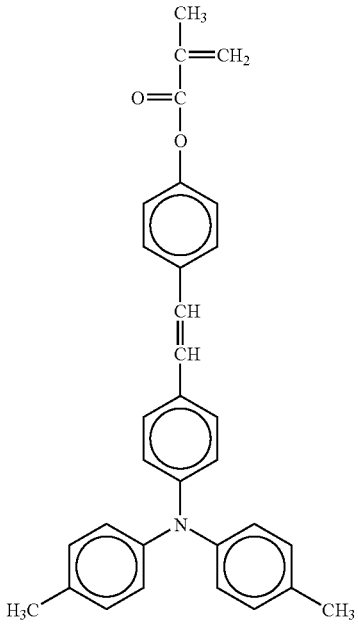

TABLE 1-8-continued
No. 111
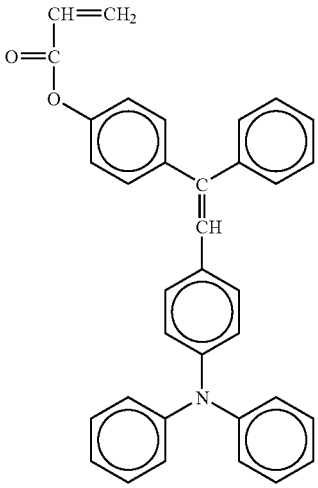
No. 112
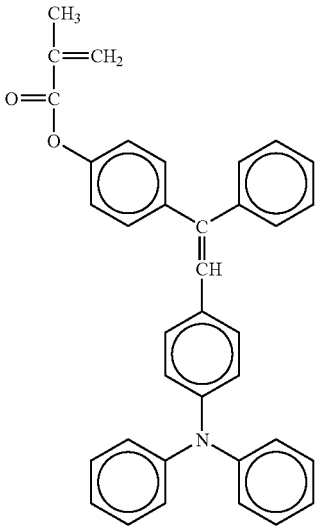
TABLE 1-9
No. 113
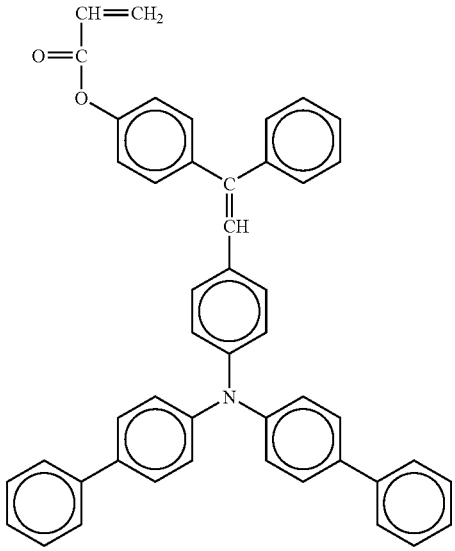
No. 114
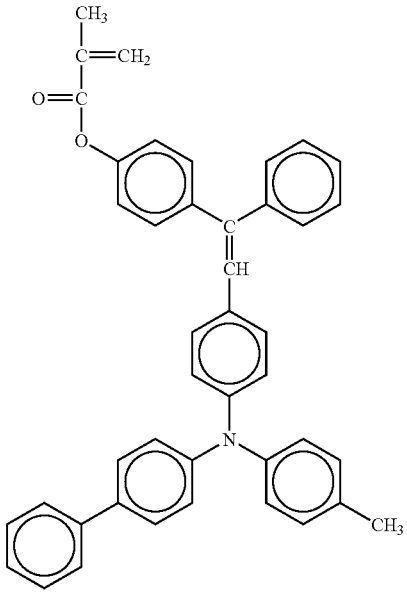

TABLE 1-9-continued
No. 115
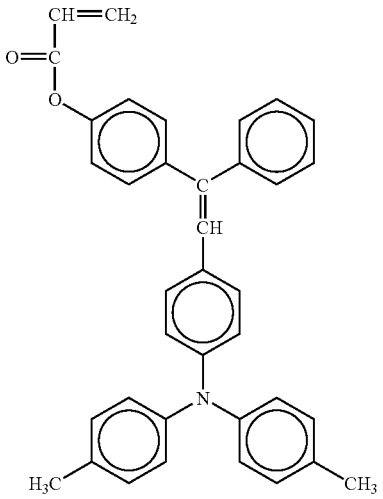
No. 116
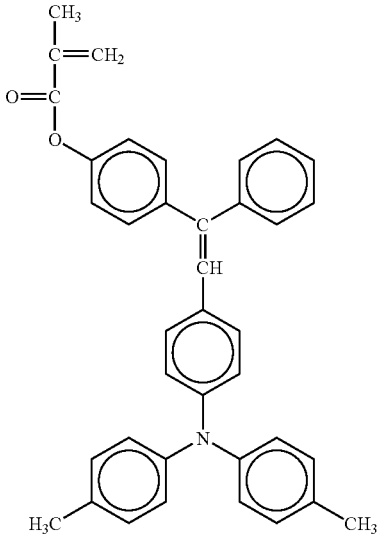
TABLE 1-9-continued
No. 117
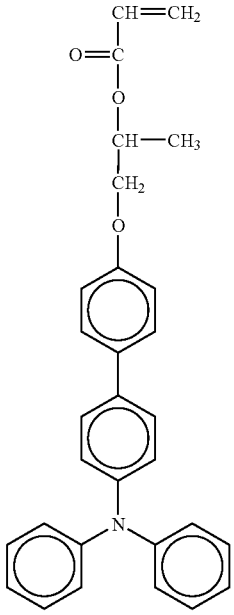
No. 118
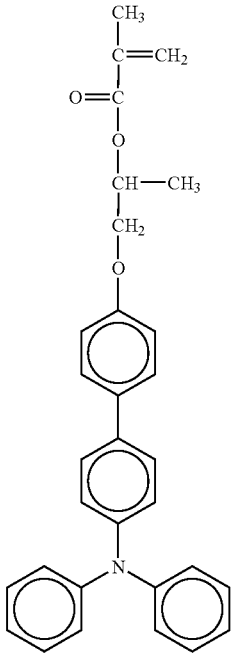

TABLE 1-9-continued
No. 119
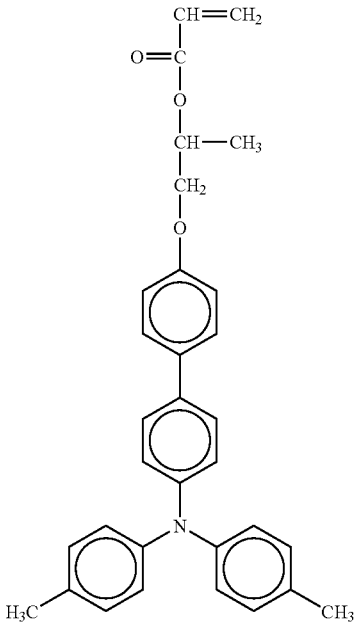
No. 120
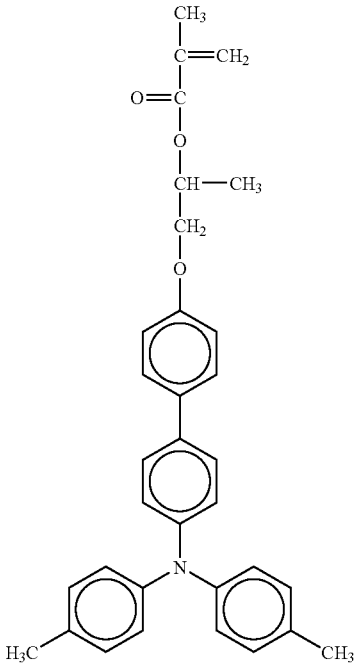
TABLE 1-9-continued
No. 121
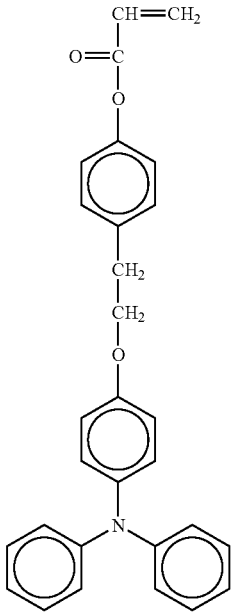
No. 122
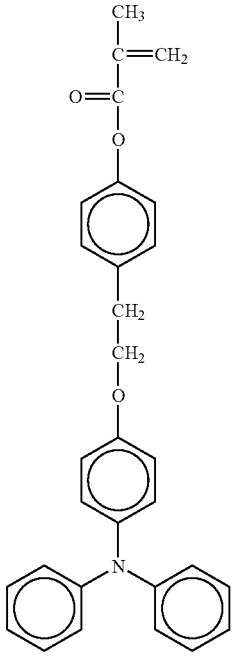

TABLE 1-9-continued
No. 123
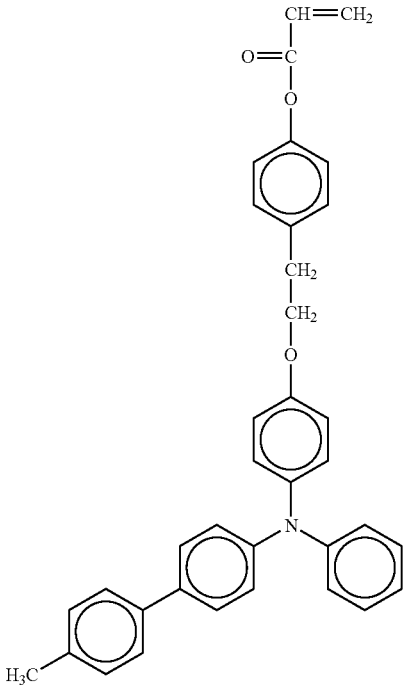
No. 124
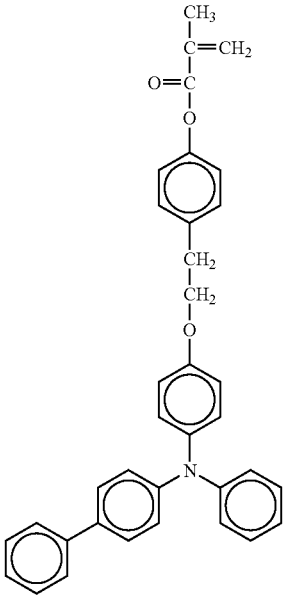
TABLE 1-10
No. 125
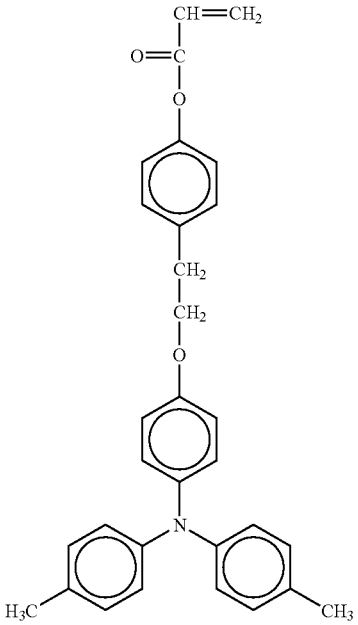
No. 126
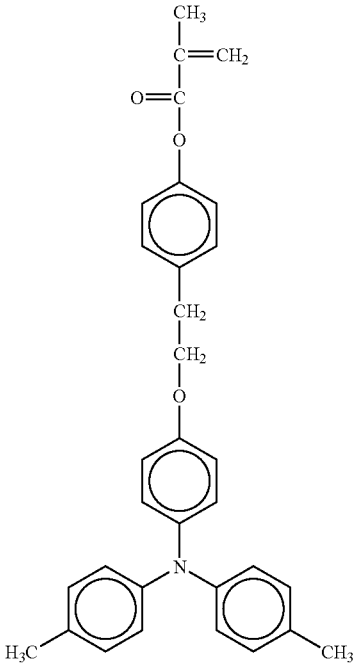

TABLE 1-10-continued
No. 127
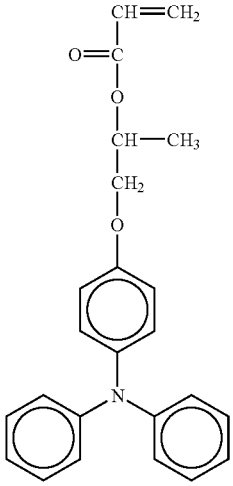
No. 128
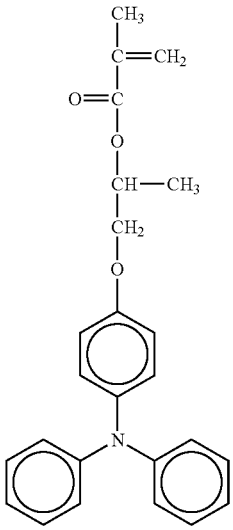
TABLE 1-10-continued
No. 129
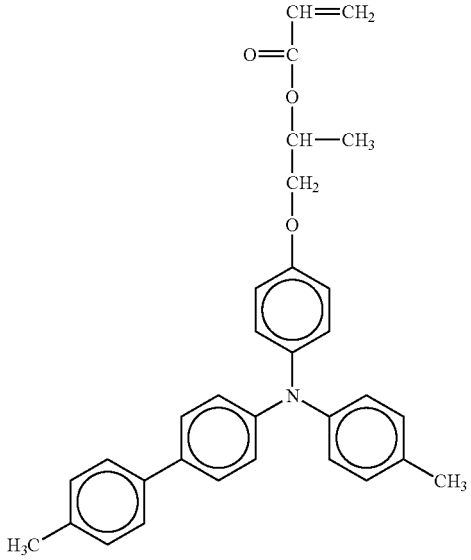
No. 130
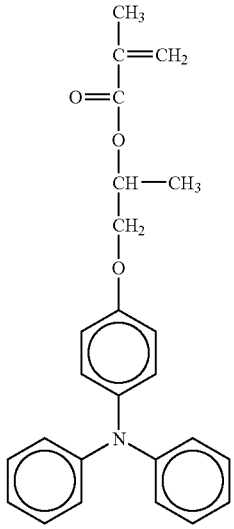

TABLE 1-10-continued
No. 131
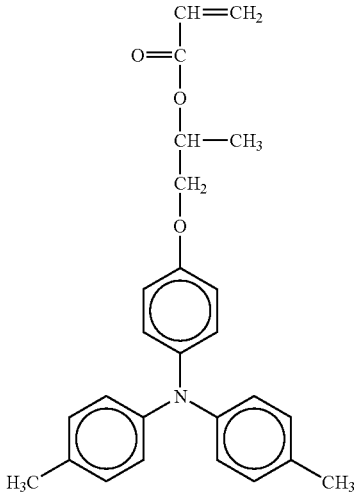
No. 132
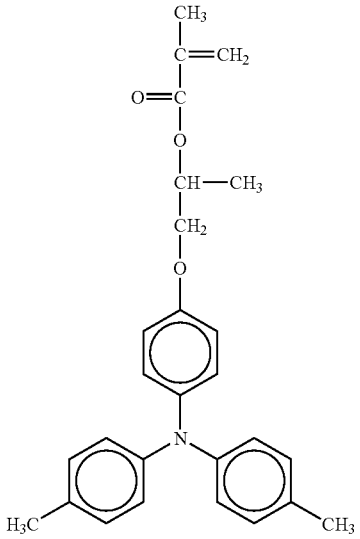
No. 133
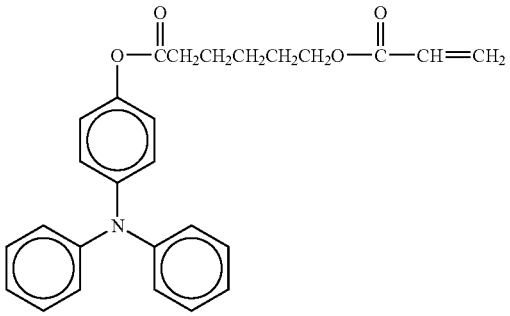
TABLE 1-10-continued
No. 134
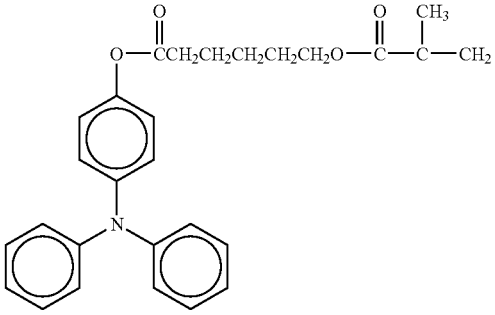
No. 135
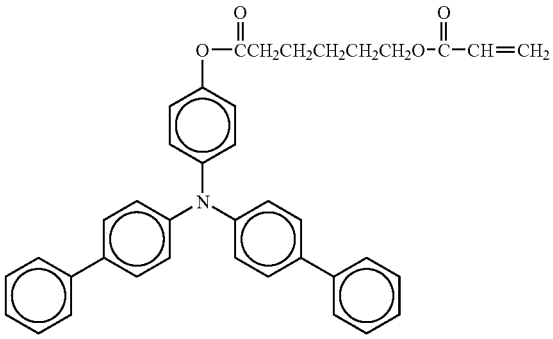
No. 136
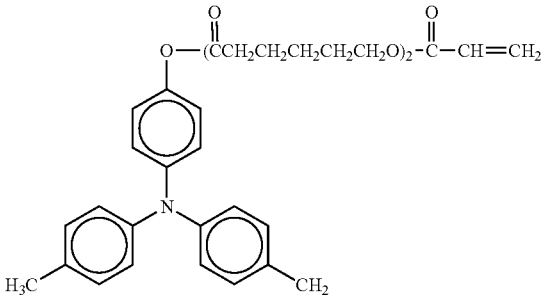

TABLE 1-11
No. 137
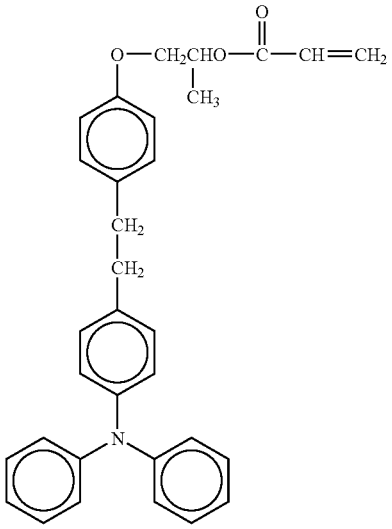
No. 138
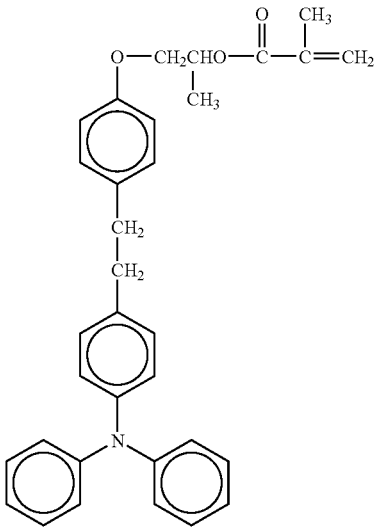
TABLE 1-11-continued
No. 139
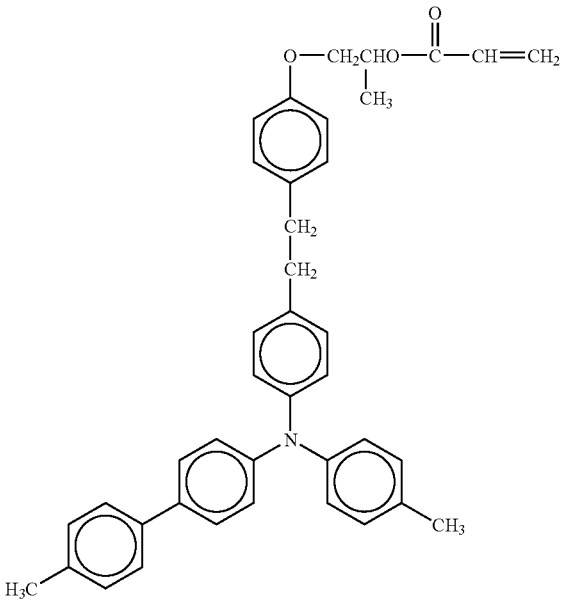
No. 140
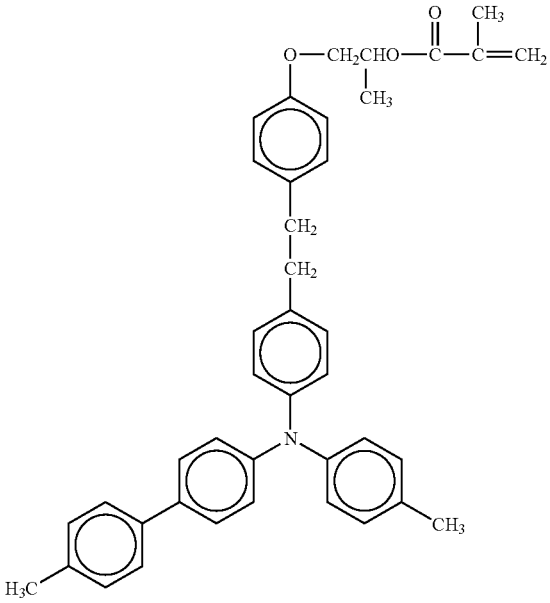

TABLE 1-11-continued
No. 141
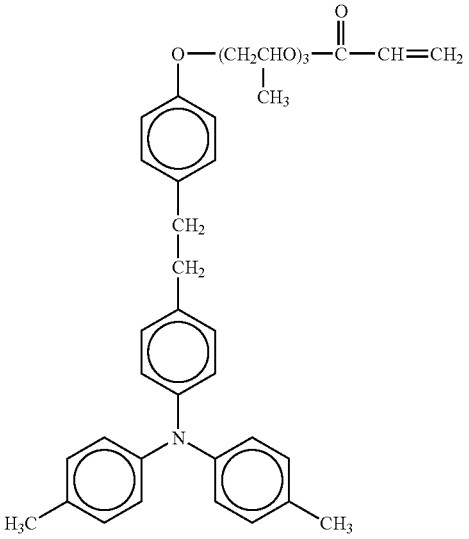
No. 142
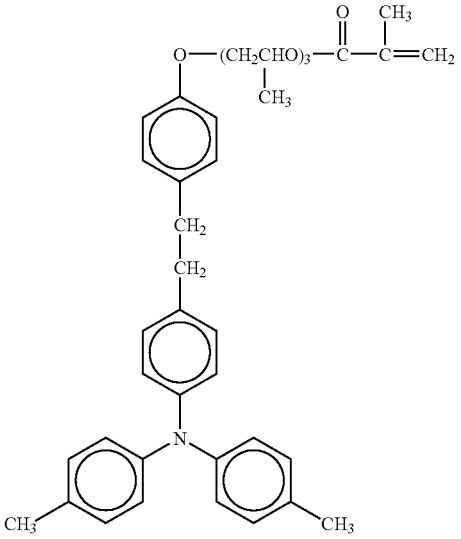
No. 143
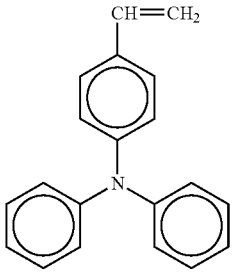
TABLE 1-11-continued
No. 144
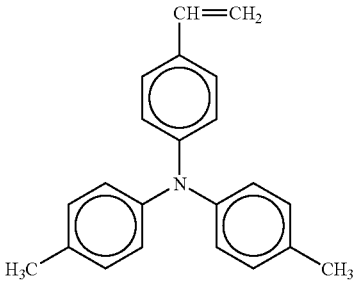
No. 145
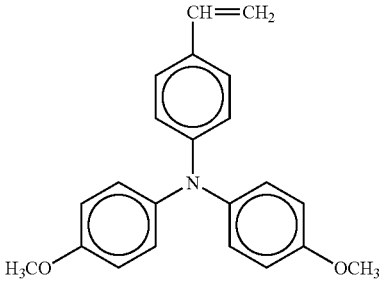
No. 146
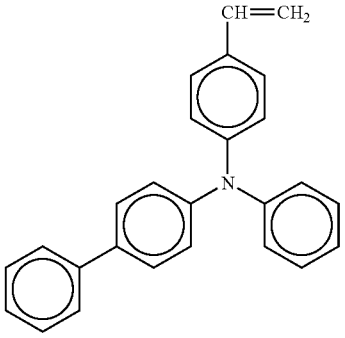
No. 147
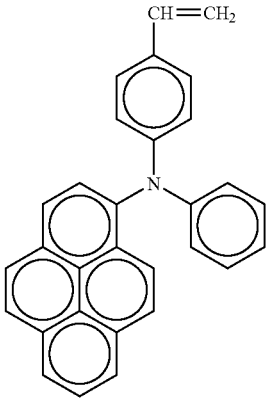

TABLE 1-11-continued
No. 148
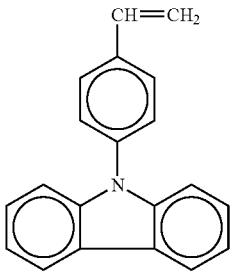
No. 149
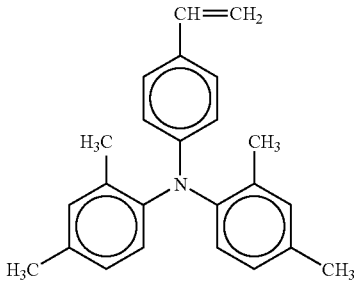
TABLE 1-12
No. 150
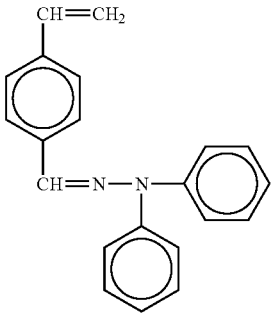
No. 151
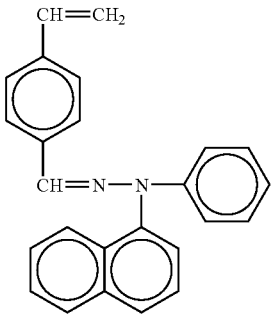
TABLE 1-12-continued
No. 152
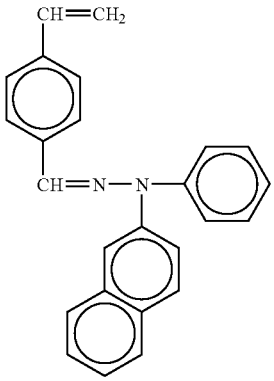
No. 153
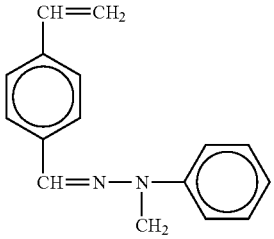
No. 154
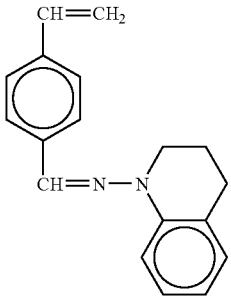
No. 155
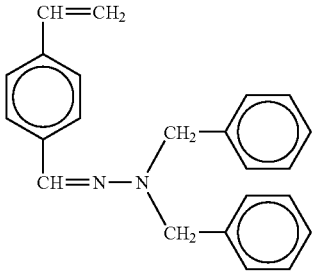
No. 156
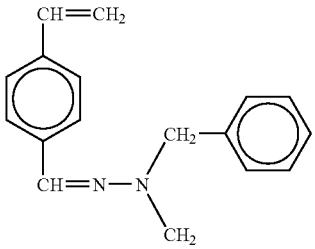

TABLE 1-12-continued

No. 157

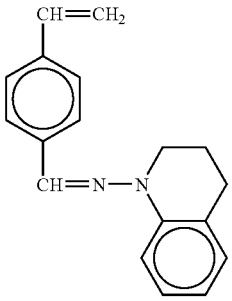

No. 158

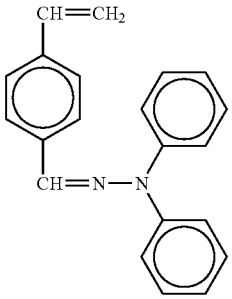

No. 159

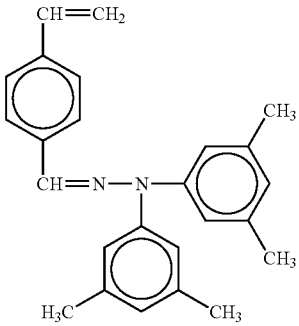

No. 160

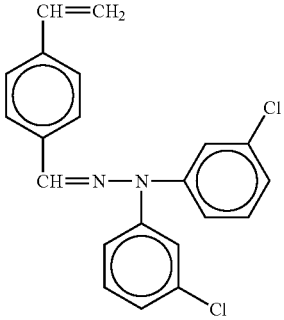

The radical polymerizing compound having one functional group with a charge transporting structure for use in the present invention is essential for imparting a charge transportability to the crosslinked surface layer, and is preferably included therein in an mount of 20 to 80% by weight, and more preferably from 30 to 70% by weight based on total weight. When less than 20% by weight, the crosslinked surface layer cannot maintain the charge transportability and the sensitivity of the resultant photoreceptor deteriorates resulting in residual potential increases by repeated use. When greater than 80% by weight, the content of the monomer having three or more functional groups without a charge transporting structure decreases and the crosslinked density deteriorates Therefore, the resultant photoreceptor does not have a high abrasion resistance. In consideration of a balance between required abrasion resistance and electrical properties, the content of the radical polymerizing compound having one functional group with a charge transporting structure is preferably from 30 to 70% by weight.

Specific examples of the reactive silicone compound having a radical polymerizing functional group and a dimethyl siloxane structure as a repeat unit include a compound having at least one radical polymerizing functional group and a dimethyl siloxane structure as a repeat unit. Specific examples of the radical polymerizing functional group include those used in the radical polymerizing monomer having three or more functional groups without a charge transporting structure, and particularly an acryloyloxy group and a methacryloyloxy group are used.

Further, in terms of hardening speed and solubility, the acryloyloxy group is more preferably used. The acryloyloxy group having two or more functional groups provide more desirable results than that having one functional group, and the acryloyloxy group having diacrylate at both ends is preferable. The reactive silicone compound optimally has a molecular weight not greater than 20,000, and ideally not greater than 10,000. When greater than 20,000, the solubility with the radical polymerizing monomer having three or more functional groups without a charge transporting structure and radical polymerizing compound having one functional group with a charge transporting structure deteriorates Therefore, the surface smoothness of the crosslinked surface layer deteriorates.

Further, the reactive silicone compound preferably has a viscosity not greater than 30 Pa·s, and more preferably not greater than 20 Pa·s at 25° C. When greater than 30 Pa·s, a surface layer coating liquid has a high viscosity if a large amount of the reactive silicone compound isused. Therefore, it becomes difficult to coat the coating liquid, and the coated layer has defects such as pin holes and small foamed bubbles resulting in deterioration of smoothness.

In the present invention, the viscosity is measured by rotary viscometer TV-20 from TOKIMEC INC. in a constant temperature tank under conditions of 1.0 rpm at 25° C. However, any devices can be used provided the devices have similar performance to TV-20.

Specific examples of the silicone compound having a radical polymerizing functional group include a compound including one radical polymerizing functional group and another compound including two radical polymerizing functional groups, and having the following formulae (4) and (5) respectively:

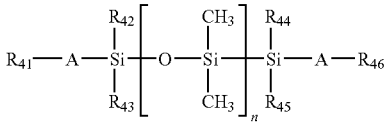

(4)

In compound (4), $R_{41}$ represents a radical polymerizing functional group used in the radical polymerizing monomer having three or more functional groups without a charge transporting structure such as an acryloyloxy group and a methacryloyloxy group; $R_{42}$, $R_{43}$, $R_{44}$, $R_{45}$ and $R_{46}$ independently represent a hydrogen atom, or an alkyl group or an aryl group having 1 to 12 carbon atoms; A represents an alkylene group having 2 to 6 carbon atoms or a single bond; and n represents an integer not less than 2.

(5)

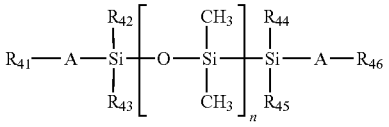

In the compound above (5), $R_{41}$ and $R_{46}$ represent a radical polymerizing functional group used in the radical polymerizing monomer having three or more functional groups without a charge transporting structure such as an acryloyloxy group and a methacryloyloxy group; $R_{42}$, $R_{43}$, $R_{44}$, $R_{45}$ and $R_{45}$ independently represent a hydrogen atom, or an alkyl group or an aryl group having 1 to 12 carbon atoms; A represents an alkylene group having 2 to 6 carbon atoms or a single bond; and n represents an integer not less than 2.

In the formulae (4) and (5), the radical polymerizing functional group is located at the end of the polysiloxane structure. However, a location of the radical polymerizing functional group of the reactive silicone compound having a radical polymerizing functional group and a dimethyl siloxane structure as a repeat unit for use in the present invention is not limited thereto, and a reactive silicone compound having a radical polymerizing functional group and a dimethyl siloxane structure as a repeat unit substituting a side chain of the polysiloxane structure can also be effectively used.

The reactive silicone compound having a radical polymerizing functional group and a dimethyl siloxane structure as a repeat unit of the present invention can be formed by a method of performing a condensed reaction between an ester formed of an acrylic or a methacrylic acid and alkylene glycol and a trimethylsilyl compound or a polydimethylsiloxane compound, or a method of performing a condensed reaction between an ester formed of an acrylic or a methacrylic acid and alylalcohol and a trimethylsilyl compound or a polydimethylsiloxane compound, a currently available product can also be used.

Specific examples of available products include X-22-164A having a molecular weight of 860, X-22-164B having a molecular weight of 1,630, X-22-164C having a molecular weight of 2,370, X-22-174DX having a molecular weight of 4,600, X-24-8201 having a molecular weight of 2,100 and X-22-2426 having a molecular weight of 12,000 from Shin-Etsu Chemical Co., Ltd.; bi-terminal Silaplane FM-7711 having a molecular weight of 1,000, bi-terminal Silaplane FM-7721 having a molecular weight of 5,000, bi-terminal Silaplane FM-7725 having a molecular weight of 10,000, mono-terminal Silaplane FM-0711 having a molecular weight of 1,000, mono-terminal Silaplane FM-0721 having a molecular weight of 5,000, mono-terminal Silaplane FM-0725 having a molecular weight of 10,000, mono-terminal Silaplane TM-0701 having a molecular weight of 423, and mono-terminal Silaplane TM-0701T having a molecular weight of 423 from CHISSO CORPORATION; BYK-UV3500, BYK-UV3510 and BYK-UV3570 from BYK Chemie Japan K.K.; and TEGO Rad 2100, TEGO Rad 2200N, TEGO Rad 2250, TEGO Rad 2500, TEGO Rad 2600 and TEGO Rad 2700 from Tego Chemie Service GmbH, and these are not limited thereto.

The reactive silicone compound can be used alone or in combination. A content of the reactive silicone compound is from 0.01 to 30% by weight, and more preferably from 0.05 to 20% by weight based on total weight of solid content in a coating liquid forming the crosslinked surface layer. When less than 0.01% by weight, the crosslinked surface layer includes not enough lubricant to have sufficient low surface energy and good cleanability. When greater than 30% by weight, an amount of the lubricant is so large that an unreacted molecule, which is not chemically taken in a matrix of the crosslinked surface layer, appears and causes variations of electrical properties of the resultant photoreceptor. Thus resulting in deterioration of image density and thin characters. Although it depends on a required abrasion resistance and electrical properties, a content of the reactive silicone compound having a radical polymerizing functional group is most preferably from 0.05 to 20% by weight based on total weight of the solid content in the coating liquid forming the crosslinked surface layer.

The surface layer of the present invention is a crosslinked surface layer wherein at least the radical polymerizing monomer having three or more functional groups without a charge transporting structure, the radical polymerizing compound having one functional group with a charge transporting structure, and the reactive silicone compound having a radical polymerizing functional group are hardened at the same time. The surface layer can also include a particulate filler to improve abrasion resistance.

Specific examples of organic filler materials include fluorocarbon resin powders such as polytetrafluoroethylene, a silicone resin powder and an A-carbon powder. Specific examples of inorganic filler materials include metallic powders such as copper, tin, aluminium and indium; metallic oxides such as a silicon oxide, an aluminium oxide, a tin oxide, a zinc oxide, a titanium oxide, an indium oxide, an antimony oxide and a bismuth oxide; and kalium titanate. The inorganic filler material is advantageously used in terms of hardness of the filler. Particularly silicon oxide, aluminium oxide and titanium oxide are more effectively used. In addition, colloidal silica and colloidal alumina are also suitable replacements.

The filler preferably has a primary particle diameter of from 0.01 to 0.5 μm in terms of a light transmittance and an abrasion resistance of the surface layer. When less than 0.01 μm, dispersibility deteriorates and the surface does not have a sufficient abrasion resistance. When greater than 0.5 μm, the filler quickly settles down in a dispersion liquid and filming of a toner over the surface layer occurs.

The higher the concentration of the filler material in the surface layer, the higher the abrasion resistance. However, when the concentration is too high, a residual potential increases and the writing light transmittance of the surface layer deteriorates. Therefore, the filler material preferably has a concentration not greater than 50% by weight, and optimally not greater than 30% by weight based on total weight of solid contents in the surface layer.

Further, a surface of the filler is preferably treated with a surface treatment agent to improve dispersibility. The dispersibility deterioration of the filler causes an increase of a residual potential and transparency deterioration of the surface layer and a defect thereof, as well as further deterioration of abrasion resistance.

Specific examples of the surface treatment agent used to include titanate coupling agents, aluminium coupling agents, zircoaluminate coupling agents, higher fatty acids and mixtures of each agent with a silane coupling agents; and $AL_2O_3$, $TiO_2$, $ZRO_2$, silicone, aluminium stearate and their mixtures. These are used to improve dispersibility of the filler and prevent blurred images. The silane coupling agents occasionally cause blurred images, but a mixture of the surface treatment agent and the silane coupling agent can prevent the influence. Although an amount of the surface treatment agent depends on the primary particle diameter of a filler, the amount is preferably from 3 to 30% by weight, and optimally from 5 to 20% by weight base on total weight of the filler. When less than 3% by weight, the filler is not well dispersed. When greater than 30% by weight, the residual potential significantly increases. These filler materials can be used alone or in combination.

The surface layer of the present invention is a crosslinked surface layer wherein at least the radical polymerizing monomer having three or more functional groups without a charge transporting structure, the radical polymerizing compound having one functional group with a charge transporting structure, and the reactive silicone compound having a radical polymerizing functional group are hardened at the same time. The surface layer can also include a radical polymerizing monomer and a radical polymerizing oligomer having one or two functional groups to control a viscosity of the surface layer when coated, reduce stress, impart a low surface free energy and reduce friction coefficient thereof. Known radical polymerizing monomers and oligomers can be used.

Specific examples of the radical monomer having one functional group include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc.

Specific examples of the radical monomer having two functional groups include 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc.

Specific examples of the functional monomers include octafluoropentylacrylate, 2-perfluorooctylethylacrylate, 2-perfluorooctylethylmethacrylate, 2-perfluoroisononylethylacrylate, etc. wherein a fluorine atom is substituted.

Specific examples of the radical polymerizing oligomer includes epoxyacrylate oligomers, urethaneacrylate oligomers and polyetseracrylate oligomers.

However, when the crosslinked surface layer includes a large amount of the radical polymerizing monomer and radical polymerizing oligomer having one or two functional groups, the three-dimensional crosslinked bonding density substantially deteriorates, resulting in deterioration of abrasion resistance. Therefore, the surface layer of the present invention preferably includes the monomers and oligomers in an amount not greater than 50 parts by weight, and not greater than 30 parts by weight per 100 parts by weight of the radical polymerizing monomer having three or more functional groups.

The surface layer of the present invention is a crosslinked surface layer wherein at least the radical polymerizing monomer having three or more functional groups without a charge transporting structure, the radical polymerizing compound having one functional group with a charge transporting structure, and the reactive silicone compound having a radical polymerizing functional group are hardened at the same time. The layer can optionally include a polymerization initiator to effectively proceed the crosslinking reaction.

Specific examples of the heat polymerization initiators include peroxide initiators such as 2,5-dimethylhexane-2,5-dihydrooxide, dicumylperoxide, benzoylperoxide, t-butylcumylperoxide, 2,5-dimethyl-2,5-di(peroxybenzoyl)hexyne-3, di-t-butylbeloxide, t-butylhydrobeloxide, cumenehydobeloxide and lauroylperoxide; and azo initiators such as azobisisobutylnitrile, azobiscyclohexanecarbonitrile, azobisisomethylbutyrate, azobisisobutylamidinehydorchloride and 4,4'-azobis-4-cyanovaleric acid.

Specific examples of the photo polymerization initiators include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinnethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds.

Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-imethylaminoisoamylbenzoate, ethyl(2-dimethylamino)benzoate and 4,4-dimethylaminobenzophenone.

These polymerization initiators can be used alone or in combination. The surface layer of the present invention preferably includes the polymerization initiators in an amount of 0.5 to 40 parts by weight, and optimally from 1 to 20 parts by weight per 100 parts by weight of the radical polymerizing compounds.

Further, a coating liquid for the surface layer of the present invention may include various additives such as plasticizers (to soften stress and improve adhesiveness thereof), leveling agents and low-molecular-weight charge transport materials without radical reactivity. Known additives can be used, and specific examples of the plasticizers include plasticizers such as dibutylphthalate and dioctylphthalate. The content is preferably not greater than 20% by weight, and optimally not greater than 10% based on total weight of solid contents of the coating liquid. Specific examples of the leveling agents include silicone oil such as dimethylsilicone oil and methylphenylsilicone oil; and polymers and oligomers having a perfluoroalkyl group in the side chain. The content thereof is preferably not greater than 3% by weight.

The coating liquid for the surface layer of the present invention can include a binder resin. However, the coating liquid is provided only if smoothness, electrical properties or durability of a surface of the photoreceptor is not impaired.

However, when a polymer material such as a binder resin is included in the coating liquid, the binder resin is insoluble with a polymer produced by a hardening reaction of the radical polymerizing compositions (the radical polymerizing monomer and the radical polymerizing compound having a charge transporting structure). Thus, phase separation appears resulting in large concavities and convexities of the crosslinked surface layer. Therefore, it is preferable not to use the binder resin.

The crosslinked surface layer of the present invention is formed by coating and hardening a coating liquid including at least the radical polymerizing monomer having three or more functional groups without a charge transporting structure, the radical polymerizing compound having one functional group with a charge transporting structure, and the reactive silicone compound having a radical polymerizing functional group. The coating liquid can include other components when the radical polymerizing monomer is a liquid, and is optionally diluted with a solvent and coated.

Specific examples of the solvent include alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and Cellosoves such as methyl Cellosolve, ethyl Cellosolve and Cellosolve acetate.

These solvents can be used alone or in combination. A dilution ratio with the solvent can be selected based on solubility of the compositions, coating method and layer thickness. The crosslinked surface layer can be coated by dip coating, spray coating, bead coating, ring coating, etc.

In the present invention, after the coating liquid is coated to form layer, an external energy is applied for hardening the layer to form the crosslinked surface layer. The external energy includes a heat, light and radiation.

Heat energy is applied to the layer from the coated side or from the substrate using air, a gaseous body such as nitrogen, steam, a variety of heating media, an infrared or an electromagnetic wave. The heating temperature is preferably from 100 to 170° C. When less than 100° C., the reaction is slow in speed and is not completed. When greater than 170° C., the reaction nonuniformly proceeds and large distortions appear in the crosslinked surface layer. After heated at comparatively a low temperature less than 100° C., to uniformly complete the hardening reaction the reaction is completed at not less than 100° C.

Specific examples of the light energy include UV irradiators such as high pressure mercury lamps and metal halide lamps having an emission wavelength of UV light; and a visible light source adaptable to absorption wavelength of the radical polymerizing compounds and photo polymerization initiators. The irradiation light amount is preferably from 50 to 1,000 mW/cm$^2$. When less than 50 mW/cm$^2$, the hardening reaction takes an excessive amount of time. When greater than 1,000 mW/cm$^2$, the reaction nonuniformly proceeds and the crosslinked surface layer has an excessive surface roughness. The radiation energy includes a radiation energy using an electron beam. Among these energies, the heat and light energies are preferable because of their simple reaction speed controls and simple apparatuses.

Since the crosslinked surface layer of the present invention has a different thickness depending on the layer structure of a photoreceptor using the crosslinked surface layer, the thickness will be described according to the following explanations of the various layer structures.

The electrophotographic photoreceptor for use in the present invention will be explained, referring to the drawings.

Figure 1B:
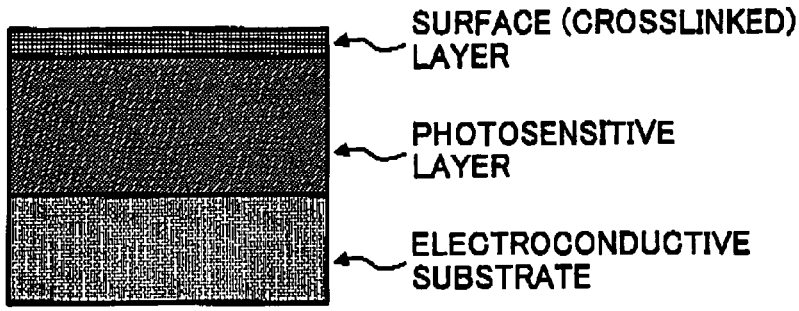

FIG. 1A and FIG. 1B are cross-sectional views of embodiments of layers of the electrophotographic photoreceptor of the present invention, which overlies an electroconductive substrate and is a single-layered photoreceptor formed of a photosensitive layer having both a charge generation function and charge transport function. In FIG. 1A, the photosensitive layer is wholly crosslinked and hardened to form a crosslinked surface layer. In FIG. 1B, a crosslinked surface layer is formed on a surface of the photosensitive layer.

Figure 2A:
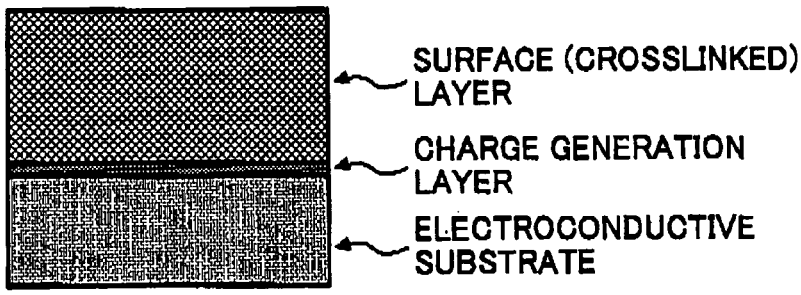
FIG. 2A and FIG. 2B are a cross-sectional views of other embodiments of layers of the electrophotographic photoreceptor of the present invention.
Figure 2B:
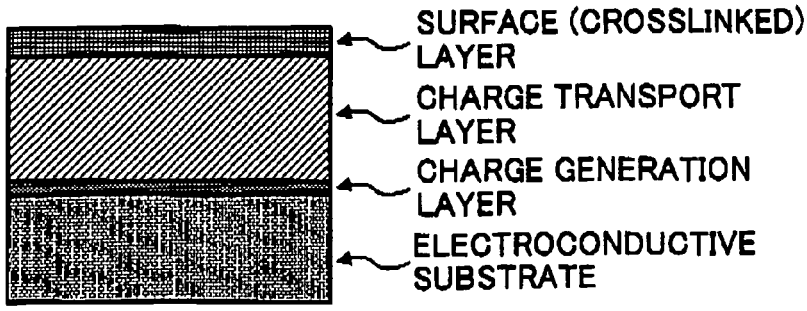

FIG. 2A and FIG. 2B are cross-sectional views of other embodiments of layers of the electrophotographic photoreceptor of the present invention, which is a multilayered photoreceptor formed of a charge generation layer having a charge generation function and a charge transport layer having a charge transport function, and which are overlying an electroconductive substrate. In FIG. 2A, the charge transport layer is wholly crosslinked and hardened to form a crosslinked surface layer. In FIG. 2B, a crosslinked surface layer is formed on a surface of the charge transport layer.

Suitable materials for use as the electroconductive substrate include materials having a volume resistance not greater than $10^{10}$ Ω·cm. Specific examples of such materials include plastic cylinders, plastic films or paper sheets. On the surface of this material is a metal such as aluminum, nickel, chromium, nichrome, copper, gold, silver, platinum and the like, or a metal oxide such as tin oxides, indium oxides and the like. The metallic layer is deposited or sputtered. In addition, a plate of a metal such as aluminum, aluminum alloys, nickel and stainless steel and a metal cylinder, can also be used as the substrate. The plate of metal is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the substrate.

Furthermore, substrates, in which a coating liquid including a binder resin and an electroconductive powder is coated on the supporters mentioned above, can be used as the substrate.

Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube made of a combination of a resin such as polyvinyl chloride, polypropylene, polyesters, polyvinylidene chloride, polyethylene, chlorinated rubber and fluorine-containing resins, with an electroconductive material, can also be used as the substrate.

Next, the photosensitive layer will be described. The photosensitive layer may be a single-layered or a multilayered. The multilayered photosensitive layer is formed of a charge generation layer having a charge generation function and a charge transport layer having a charge transport function. The single-layered photosensitive layer is a layer having both the charge generation function and charge transport function.

Hereinafter, the multilayered photosensitive layer and single-layered photosensitive layer will be explained respectively.

The charge transport layer (CGL) is mainly formed of a charge generation material, and optionally includes a binder resin. Suitable charge generation materials include inorganic materials and organic materials.

Specific examples of the inorganic charge generation materials include crystalline selenium, amorphous selenium, selenium-tellurium alloys, selenium-tellurium-halogen alloys and selenium-arsenic alloys.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge transport materials can be used alone or in combination.

Specific examples of the binder resin optionally used in the CGL include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination.

In addition, a charge transport polymer material aside from the above-mentioned binder resins can also be used in the CGL. Specific examples include polymer materials such as polycarbonate resins, polyester resins, polyurethane resins, polyether resins, polysiloxane resins and acrylic resins having an arylamine skeleton, a benzidine skeleton, a hydrazone skeleton, a carbazole skeleton, a stilbene skeleton, a pyrazoline skeleton, etc.; and polymer materials having polysilane skeleton.

Specific examples of the former polymer materials include charge transport polymer materials disclosed in Japanese Laid-Open Patent Publications Nos. 01-001728, 01-009964, 01-013061, 01-019049, 01-241559, 04-011627, 04-175337, 04-183719, 04-225014, 04-230767, 04-320420, 05-232727, 05-310904, 06-234838, 06-234839, 06-234840, 06-234839, 06-234840, 06-234841, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, etc.

Specific examples of the latter polymer materials include polysilylene polymers disclosed in Japanese Laid-Open Patent Publications Nos. 63-285552, 05-19497, 05-70595, 10-73944, etc.

The CGL also can include a low-molecular-weight charge transport material.

The low-molecular-weight charge transport materials include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoquinone derivatives, etc. These electron transport materials can be used alone or in combination.

Specific examples of the positive hole transport materials include electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials. These positive hole transport materials can be used alone or in combination.

Suitable methods for forming the charge generation layer are classified into vacuum thin film forming method and solvent dispersion casting method.

Specific examples of the former vacuum thin film forming method include a vacuum evaporation method, a glow discharge decomposition method, an ion plating method, a sputtering method, a reaction sputtering method, CVD (chemical vapor deposition) methods, etc. A layer of the above-mentioned inorganic and organic materials can be formed by the above methods.

The casting method for forming the charge generation layer typically includes the following steps:

(1) preparing a coating liquid by mixing one or more inorganic or organic charge generation materials mentioned above with a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc., optionally with a binder resin and a leveling agent such as a dimethylsilicone oil and methylphenyl silicone oil. Then dispersing the materials with a ball mill, an attritor, a sand mill, beads mill, etc. to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The thickness of the CGL is preferably from about 0.01 to about 5 μm, and optimally from about 0.05 to about 2 μm.

The charge transport layer (CTL) is a layer having a charge transportability, and the crosslinked surface layer of the present invention is effectively used as a CTL. After a coating liquid including the radical polymerizing monomer having three or more functional groups without a charge transporting structure; radical polymerizing compound having one functional group with a charge transporting structure; and reactive silicone compound having a radical polymerizing functional group (hereinafter referred to as the radical polymerizing compositions) is coated on the CGL and is optionally dried to form a coated layer thereon, an external energy is applied thereto to harden the coated layer to form the crosslinked surface layer. The crosslinked surface layer preferably has a thickness of from 10 to 30 μm, and optimally from 10 to 25 μm. When thinner than 10 μm, a sufficient charged potential cannot be maintained. When thicker than 30 μm, a contraction in volume when hardened tends to cause separation from a lower layer.

When the crosslinked surface layer is formed on a surface of the CTL, the CTL is formed by coating a CGL with a coating liquid wherein a charge transport material having a charge transportability and a binder resin are dispersed in a proper solvent to form a coated layer is dried. The crosslinked surface layer is formed by coating the CGL with a coating liquid including the above-mentioned radical polymerizing compositions of the present invention to form a coated layer thereon, and crosslinking and hardening the coated layer with an external energy.

Specific examples of charge transport materials include electron transport materials, positive hole transport materials and charge transport polymer materials used in the CGL. Particularly, the charge transport polymer materials are used to reduce a solution of a lower layer when a surface layer is coated thereon.

Specific examples of the binder resins include thermoplastic or thermosetting resins such as polystyrene, styrene-acrylonitrile copolymers, styrene-butadiene copolymers, styrene-maleic anhydride copolymers, polyester, polyvinylchloride, vinylchloride-vinylacetate copolymers, polyvinylacetate, polyvinylidenechloride, polyarylate resins, phenoxy resins, polycarbonate, cellulose acetate resins, ethylcellulose resins, polyvinylbutyral, polyvinylformal, polyvinyltoluene, poly-N-vinylcarbazole, acrylic resins, silicone resins, epoxy resins, melamine resins, urethane resins, phenol resins and alkyd resins.

The CTL preferably includes the charge transport material in an amount of from 20 to 300 parts by weight, and optimally from 40 to 150 parts by weight per 100 parts by weight of the binder resin. However, the charge transport polymer material can be used alone or in combination with the binder resin.

Specific examples of the solvent used for coating the CTL include the solvents previously discussed used for coating the CGL, and particularly the solvents optimizing the charge transport material and binder resin. These solvents can be used alone or in combination. The CTL can be formed by the same coating methods used for coating the CGL.

The CTL may optionally include a plasticizer and a leveling agent.

Specific examples of the plasticizers include plasticizers for typical resins, such as dibutylphthalate and dioctylphthalate, and a content thereof is preferably from 0 to 30 parts by weight per 100 parts by weight of the binder resin.

Specific examples of the leveling agents include silicone oil such as dimethyl silicone oil and methylphenyl silicone oil; and polymers or oligomers having a perfluoroalkyl group in the side chain, and a content thereof is preferably from 0 to 1 part by weight per 100 parts by weight of the binder resin.

The CTL preferably has a thickness of from 5 to 40 μm, and optimally from 10 to 30 μm.

When the crosslinked surface layer overlies the CTL, as mentioned in the method of forming a crosslinked surface layer, a coating liquid including the radical polymerizing compositions of the present invention is coated on the CTL and optionally dried to form a coated layer. An external energy is then applied to harden the coated layer to form the crosslinked surface layer. The crosslinked surface layer preferably has a thickness of from 1 to 20 μm, and optimally from 2 to 10 μm. When thinner than 1 μm, uneven thickness causes uneven durability. When thicker than 20 μm, a total thickness of the CTL and crosslinked surface layer is so thick that charges are scattered, resulting in deterioration of image reproducibility of the resultant photoreceptor.

The single-layered photosensitive layer has both a charge generation function and a charge transport function. The crosslinked surface layer has a charge transporting structure including a charge generation material with a charge generating function of the present invention and is effectively used as a single-layered photosensitive layer. As mentioned in the casting method of forming the CGL, a charge generation material is dispersed in a coating liquid including the radical polymerizing compositions, and the coating liquid is coated on an electroconductive substrate and dried to form a coated layer. Then a hardening reaction is performed in the coated layer with an external energy to form the crosslinked surface layer. The charge generation material may previously be dispersed in a solvent to prepare a dispersion, and the dispersion may be added into the coating liquid for forming the crosslinked surface layer. The crosslinked surface layer preferably has a thickness of from 10 to 30 μm, and optimally from 10 to 25 μm. When thinner than 10 μm, a sufficient charged potential cannot be maintained. When thicker than 30 μm, a contraction in volume when hardened causes separation from an undercoat layer.

When the crosslinked surface layer overlies a single-layered photosensitive layer, the photosensitive layer can be formed by coating and drying a liquid wherein a charge generation material having a charge generation function, a charge transport material having a charge transport function and a binder resin are dispersed or dissolved in a proper solvent. The photosensitive layer may optionally include an additive such as plasticizers and leveling agents. The methods of dispersing a charge generation material, charge generation materials, charge transport materials, plasticizers and leveling agents mentioned in the above CGL and CTL can be used. Besides the binder resins mentioned in the above CTL, the binder resins in the above CGL can be mixed. In addition, the above-mentioned charge transport polymer material can effectively be used to prevent components of the lower photosensitive layer from mixing in the crosslinked surface layer. The photosensitive layer preferably has a thickness of from 5 to 30 μm, and optimally from 10 to 25 μm.

When the crosslinked surface layer overlies a single-layered photosensitive layer, as mentioned in the method of forming a crosslinked surface layer, a coating liquid including the radical polymerizing compositions of the present invention and a binder resin are coated on the photosensitive layer and optionally dried to form a coated layer. An external energy is then applied to harden the coated layer to form the crosslinked surface layer. The crosslinked surface layer preferably has a thickness of from 1 to 20 μm, and optimally from 2 to 10 μm. When thinner than 1 μm, uneven thickness causes uneven durability.

The single-layered photosensitive layer preferably includes a charge generation material in an amount of from 1 to 30% by weight, a binder resin of from 20 to 80% by weight and a charge transport material of from 10 to 70 parts by weight based on total weight of the layer.

The photoreceptor of the present invention can have an intermediate layer between a crosslinked surface layer and a photosensitive layer when the crosslinked surface layer overlies the intermediate layer. The intermediate layer prevents components of the lower photosensitive layer from mixing in the crosslinked surface layer and avoids inhibition in the hardening reaction and concavities and convexities that occur as a result. In addition, the intermediate layer can improve an adhesiveness between the crosslinked surface layer and photosensitive layer.

The intermediate layer includes a resin as a main component. Specific examples of the resin include polyamides, alcohol-soluble nylons, water-soluble polyvinyl butyral, polyvinyl butyral, polyvinyl alcohol, etc. The intermediate layer can be formed by one of the above-mentioned known coating methods. The intermediate layer preferably has a thickness of from 0.05 to 2 μm.

The photoreceptor of the present invention may have an undercoat between the substrate and photosensitive layer. The undercoat layer includes a resin as a main component. Since a photosensitive layer is typically formed on the undercoat layer by coating a liquid including an organic solvent, this resin in the undercoat layer has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method similarly to those used in the formation of the photosensitive layer mentioned above. The undercoat layer may be formed using a silane coupling agent, titanium coupling agent or a chromium coupling agent. In addition, a layer of aluminum oxide, which is formed by an anodic oxidation method, and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Besides these materials, other materials can be used. The thickness of the undercoat layer is preferably from 0 to 5 μm.

In the present invention, an antioxidant can be included in each of the layers, i.e., the crosslinked surface layer, charge generation layer, charge transport layer, undercoat layer and intermediate layer. The antioxidant is added to improve the stability to withstand environmental conditions, namely to avoid decrease of photosensitivity and increase residual potential.

Specific examples of the antioxidant for use in the present invention include the following compound.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, etc.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(d) Organic Sulfur-containing Compounds

Dilauryl-3,3'-thiodipropionate, distearyl-3,3'-thiodipropionate, ditetradecyl-3,3'-thiodipropionate, etc.

(e) Organic Phosphorus-containing Compounds

Triphenylphosphine, tri(nonylphenyl)phosphine, tri(dinonylphenyl)phosphine, tricresylphosphine, tri(2,4-dibutylphenoxy)phosphine, etc.

These compounds are known as antioxidants for rubbers, plastics, fats, etc., and can easily be obtained.

Each of the layers preferably includes the antioxidant in an amount of 0.01 to 10% by weight based on total weight.

Next, the image forming method and image forming apparatus of the present invention will be explained in detail, referring to the drawings.

The image forming method and image forming apparatus of the present invention include a photoreceptor having a smooth transporting crosslinked surface layer having a low surface energy, wherein the photoreceptor is charged and irradiated with an imagewise light to form an electrostatic latent image thereon; the electrostatic latent image is developed to form a toner image; the toner image is transferred onto an image bearer (transfer sheet) and fixed thereon; and a surface of the photoreceptor is cleaned.

The process is not limited to direct transfer of an electrostatic latent image onto a transfer sheet and development of the electrostatic latent image.

Figure 3:
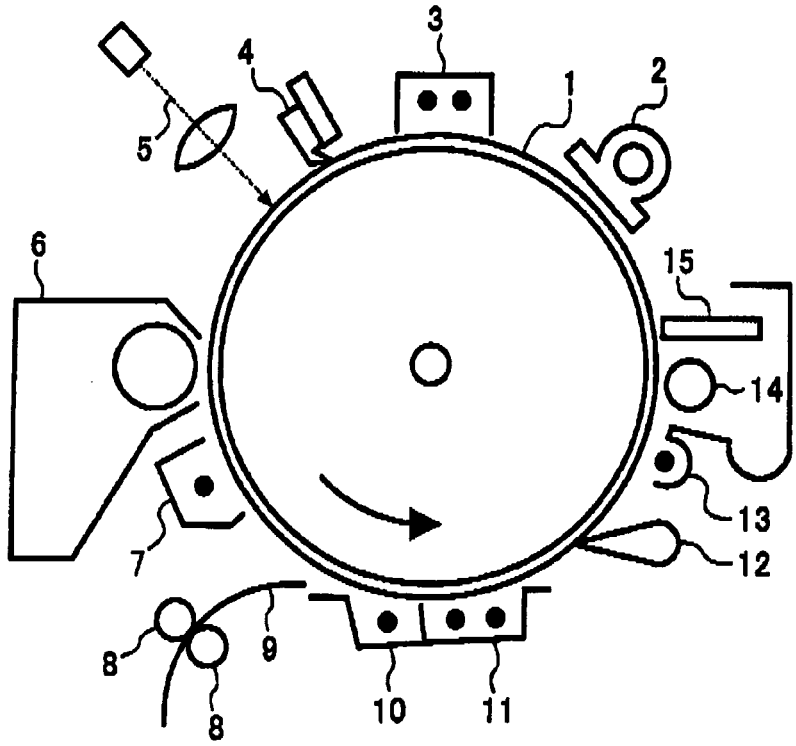
FIG. 3 is a schematic view illustrating a partial cross-section of an embodiment of the image forming apparatus of the present invention.

FIG. 3 is a schematic view illustrating a partial cross-section of an embodiment of the image forming apparatus of the present invention. A charger (3) is used to uniformly charge a photoreceptor (1). Specific examples of the charger include known chargers such as corotron devices, scorotron device, solid state chargers, needle electrode devices, roller charging devices and electroconductive brush devices.

Next, an imagewise irradiator (5) is used to form an electrostatic latent image on the photoreceptor (1). Suitable light sources include light emitters such as fluorescent lamps, tungsten lamps, halogen lamps, mercury lamps, sodium lamps, light emitting diodes (LEDs), laser diodes (LDs), light sources using electroluminescence (EL), etc. In addition, to obtain light having a desired wave length, filters such as sharp-cut filters, band pass filters, near-infrared cutting filters, dichroic filters, interference filters and color temperature converting filters can be used.

Next, a developing unit (6) is used to visualize an electrostatic latent image formed on the photoreceptor (1). The developing methods include a one-component developing method and a two-component developing method using a dry toner; and a wet developing method using a wet toner. When the photoreceptor positively or negatively charged is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner having a positive charge, a negative image can be obtained.

Next, a transfer charger (10) is used to transfer a toner image visualized on the photoreceptor onto a transfer sheet (9). A pre-transfer charger (7) may be used to improve this transfer process. Suitable transferers include a transferer charger, an electrostatic transferer using a bias roller, an adhesion transferer, a mechanical transferer using a pressure and a magnetic transferee. The above-mentioned chargers can be used for the electrostatic transferee.

Next, a separation charger (11) and a separation pick (12) are used to separate the transfer sheet (9) from the photoreceptor (1). Other separation means include an electrostatic absorption induction separator, a side-edge belt separator, a tip grip conveyor, a curvature separator, etc. The above-mentioned chargers can be used for the separation charger (11).

Next, a fur brush (14) and a cleaning blade (15) are used to remove a toner left on the photoreceptor after transfer. A pre-cleaning charger (13) may be used to perform the cleaning more effectively. Other cleaners include a web cleaner, a magnet brush cleaner, etc., and these cleaners can be used alone or in combination.

Next, a discharger is optionally used to remove a latent image in the photoreceptor. The discharger includes a discharge lamp (2) and a discharger, and the above-mentioned light sources and chargers can be used respectively.

Known means can be used for other an original reading process, a paper feeding process, a fixing process, a paper delivering process, etc.

Figure 4:
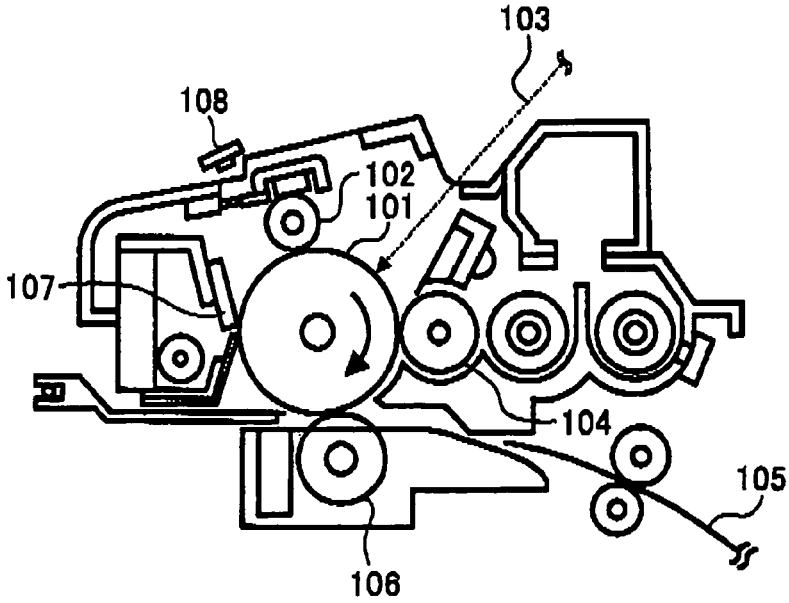
FIG. 4 is a schematic view illustrating a cross-section of an embodiment of the process cartridge for the image forming apparatus of the present invention.

The above-mentioned image forming unit may be fixedly set in a copier, a facsimile or a printer. However, the image forming unit may be detachably set therein as a process cartridge. FIG. 4 is a schematic view illustrating a cross-section of an embodiment of the process cartridge for the image forming apparatus of the present invention.

The process cartridge means an image forming unit (or device) which includes a photoreceptor (101) and at least one of a charger (102), an image developer (104), a transferer (106), a cleaner (107) and a discharger (not shown).

While the photoreceptor (101) rotates in a direction indicated by an arrow, the photoreceptor (101) is charged by the charger (102) and irradiated by an irradiator (103) to form an electrostatic latent image relevant to imagewise light. The electrostatic latent image is developed by the image developer (104) with a toner to form a form a toner image, and the toner image is transferred by the transferer (106) onto a transfer sheet (105) to be printed. Next, a surface of the photoreceptor after the toner image is transferred is cleaned by the cleaner (107), discharged by a discharger (not shown) and these processes are repeated.

As is apparent from the explanations mentioned above, the electrophotographic photoreceptor of the present invention can widely be used in electrophotography applied fields such as a laser beam printer, a CRT printer, a LED printer, a liquid crystal printer and a laser engraving.

The compound having a charge transporting structure of the present invention is synthesized by, e.g., a method disclosed in Japanese Patent No. 3164426. The following method is such an example.

(1) Synthesis of a Hydroxy Group Substituted Triarylamine Compound Having the Following Formula B 113.85 g (0.3 mol) of a methoxy group substituted triarylamine compound having the formula A, 138 g (0.92 mol) of sodium iodide and 240 ml of sulfolane were mixed to prepare a mixture. The mixture was heated to have a temperature of 60° C. in a nitrogen stream.

A

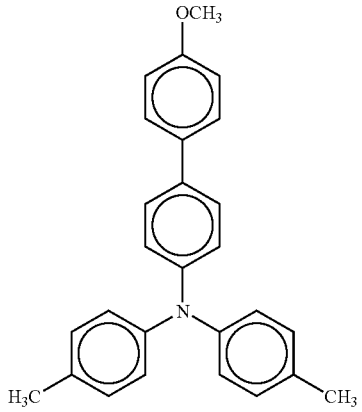

99 g (0.91 mol) of trimethylchlorosilane were dropped therein for 1 hr and the mixture was stirred for 4 hrs at about 60° C. About 1.5 L of toluene were added thereto and the mixture was cooled to have a room temperature, and repeatedly washed with water and an aqueous solution of sodium carbonate. Then, a solvent was removed and refined by a column chromatographic process using silica gel as an absorption medium, and toluene and ethyl acetate (20-to-1) as a developing solvent. Cyclohexane was added to the buff yellow oil to separate a crystal out. Thus, 88.1 g (yield of 80.4%) of a white crystal having the following formula B and a melting point of from 64.0 to 66.0° C. was prepared.

B

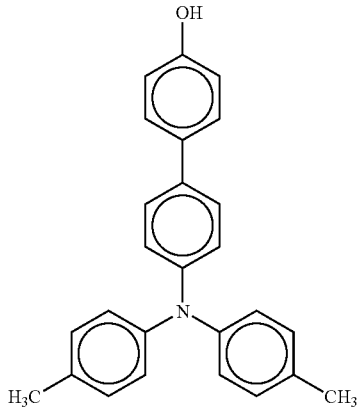

(2) A Triarylamino Group Substituted Acrylate Compound (Compound No. 54 in Table 1)

82.9 g (0.227 mol) of the hydroxy group substituted triarylamine compound having the formula B prepared in (1) were dissolved in 400 ml of tetrahydrofuran to prepare a mixture. An aqueous solution of sodium hydrate formed of 12.4 g of NaOH and 100 mil of water was dropped therein in a nitrogen stream. The mixture was cooled to have a temperature of 5° C., and 25.2 g (0.272 mol) of chloride acrylate was dropped therein for 40 min. Then, the mixture was stirred at 5° C. for 3 hrs. The mixture was put in water and extracted with toluene. The extracted liquid was repeatedly washed with water and an aqueous solution of sodium carbonate. Then, a solvent was removed and refined by a column chromatographic process using silica gel as an absorption medium and toluene as a developing solvent. N-hexane was added to the colorless oil to separate a crystal. Thus, 80.73 g (yield of 84.8%) of a white crystal of the compound No. 54 having a melting point of from 117.5 to 119.0° C. was prepared.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An undercoat coating liquid, a charge generation coating liquid and charge transport coating liquid, which have the following formulations, were coated in this order on an aluminium cylinder by a dip coating method and dried to prepare a photoreceptor 1 having an undercoat layer of 3.5 μm thick, a CGL of 0.2 μm thick, a CTL of 23 μm thick.

| Undercoat layer coating liquid | |
|---|---|
| Titanium dioxide powder | 400 |
| Melamine resin | 65 |
| Alkyl resin | 120 |
| 2-butanone | 400 |
| CGL coating liquid | |
| Bisazo pigment having the following formula: | 12 |

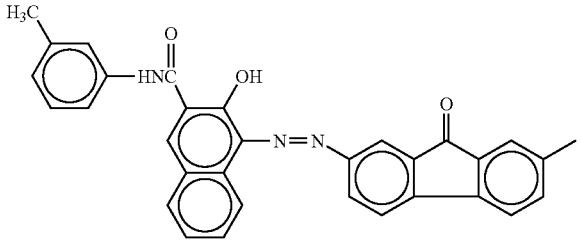

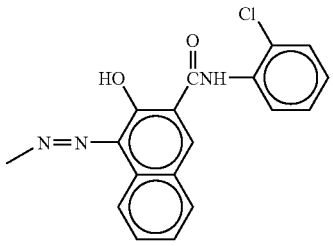

| | |
|---|---|
| Bisphenol Z-type Polycarbonate | 5 |
| 2-butanone | 200 |
| Cyclohexanone | 400 |
| CTL coating liquid | |
| Bisphenol Z-type Polycarbonate | 10 |
| CTM having the following formula: | 10 |

-continued

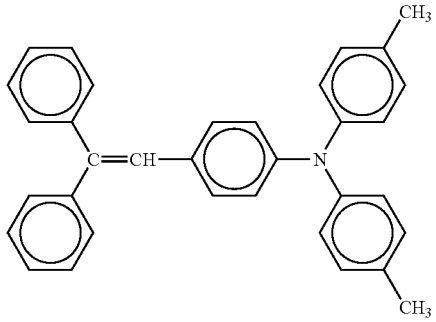

| | |
|---|---|
| Tetrahydrofuran | 100 |

The CTL was further coated with a crosslinked surface layer coating liquid having the following formulation by a spray coating method.

| Crosslinked surface layer coating liquid | |
|---|---|
| Radical polymerizing monomer having three or more functional groups without a charge transporting structure Trimethylolpropanetriacrylate (TMPTA) from TOKYO KASEI KOGYO Co., Ltd. having a molecular weight (Mw) of 296.32, 3 functional groups (Fg), and a ratio (Mw/Fg) of 99 | 95 |
| Radical polymerizing compound having one functional group with a charge transporting structure Compound No. 54 | 95 |
| Photo polymerization initiator 1-hydroxy-cyclohexyl-phenyl-ketone IRGACURE 184 from CIBA SPECIALTY CHEMICALS | 10 |
| Tetrahydrofuran | 1,200 |
| Reactive silicone compound having a radical polymerizing functional group Bi-terminal methacryl-modified polysiloxane X-22-164A from Shin-Etsu Chemical Co., Ltd. having a molecular weight of 860 | 10 |

The coated layer was irradiated by a metal halide lamp with an irradiation intensity of 700 mW/cm$^2$ for 20 sec, and further dried at 130° C. for 30 min to form a crosslinked surface layer.

Thus, an electrophotographic photoreceptor was prepared.

Example 2

The procedure for preparation of the electrophotographic photoreceptor in Example 1 was repeated to prepare an electrophotographic photoreceptor with the exception of changing the Reactive silicone compound having a radical polymerizing functional group to:

Mono-terminal methacryl-modified polysiloxane X-22-174DX from Shin-Etsu Chemical Co., Ltd. having a molecular weight of 4,600, a viscosity of 60 mm$^2$/s, a refraction index at 25° C. of 1.407, and a specific gravity at 25° C. of 0.97.

Example 3

The procedure for preparation of the electrophotographic photoreceptor in Example 1 was repeated to prepare an electrophotographic photoreceptor with the exception of changing the Reactive silicone compound having a radical polymerizing functional group to:

Polydimethylsiloxane having
a polyether-modified acrylic group
BYK-UV3500 from BYK Chemie Japan K.K Example 4

The procedure for preparation of the electrophotographic photoreceptor in Example 1 was repeated to prepare an electrophotographic photoreceptor with the exception of changing the Reactive silicone compound having a radical polymerizing functional group to the following one:
Polydimethylsiloxane having
a polyester-modified acrylic group
(PO modified-2-neopenthylglycoldiacrylate)
BYK-UV357 from BYK Chemie Japan K.K Example 5

The procedure for preparation of the electrophotographic photoreceptor in Example 1 was repeated to prepare an electrophotographic photoreceptor with the exception of changing the Reactive silicone compound having a radical polymerizing functional group to the following, and the content thereof to 0.11.
Crosslink reactive silicone compound
polyetheracrylate
TEGO Rad 2200N from Tego Chemie Service GmbH Example 6

The procedure for preparation of the electrophotographic photoreceptor in Example 1 was repeated to prepare an electrophotographic photoreceptor with the exception of changing the Reactive silicone compound having a radical polymerizing functional group to the following, and the content thereof to 50.
Bi-terminal Silaplane FM-7721 having a molecular weight of 5,000 from CHISSO CORPORATION Example 7

The procedure for preparation of the electrophotographic photoreceptor in Example 1 was repeated to prepare an electrophotographic photoreceptor with the exception of changing the radical polymerizing monomer having three or more functional groups without a charge transporting structure to:
Pentaerythritoltetraacrylate SR-295
having a molecular weight (Mw)of 352.34,
four function groups (Fg), and
a ratio (Mw/Fg) of 88 from Sartomer Company, Inc.

Example 8

The procedure for preparation of the electrophotographic photoreceptor in Example 1 was repeated to prepare an electrophotographic photoreceptor with the exception of changing the radical polymerizing monomer having three or more functional groups without a charge transporting structure to:
Dipentaerythritolhexaacrylate KAYARAD DPHA
having a molecular weight (Mw) of 551.55,
5.5 function groups (Fg), and
a ratio (Mw/Fg) of 100 from Nippon Kayaku Co., Ltd.

Example 9

The procedure for preparation of the electrophotographic photoreceptor in Example 1 was repeated to prepare an electrophotographic photoreceptor with the exception of changing the radical polymerizing monomer having three or more functional groups without a charge transporting structure to:
Caprolactone-modified dipentaerythritolhexaacrylate
KAYARAD DPCA-120
having a molecular weight (Mw)of 1,948.3,
6 function groups (Fg), and
a ratio (Mw/Fg) of 325 from Nippon Kayaku Co., Ltd.

Example 10

The procedure for preparation of the electrophotographic photoreceptor in Example 1 was repeated to prepare an electrophotographic photoreceptor with the exception of changing the radical polymerizing compound having one functional group with a charge transporting structure to the compound No. 16.

Example 11

The procedure for preparation of the electrophotographic photoreceptor in Example 1 was repeated to prepare an electrophotographic photoreceptor with the exception of changing the radical polymerizing compound having one functional group with a charge transporting structure to the compound No. 24.

Example 12

The procedure for preparation of the electrophotographic photoreceptor in Example 1 was repeated to prepare an electrophotographic photoreceptor with the exception of changing the crosslinked surface layer coating liquid to:

| Crosslinked surface layer coating liquid | |
|---|---|
| Radical polymerizing monomer having three or more functional groups without a charge transporting structure<br>Caprolactone-modified dipentaerythritolhexaacrylate KAYARAD DPCA-120 having a molecular weight (Mw)of 1,948.3, 6 function groups (Fg), and a ratio (Mw/Fg) of 325 from Nippon Kayaku Co., Ltd. | 90 |
| Radical polymerizing compound having one functional group with a charge transporting structure<br>Compound No. 54 | 90 |
| Photo polymerization initiator | 20 |
| 1-hydroxy-cyclohexyl-phenyl-ketone<br>IRGACURE 184 from CIBA SPECIALTY CHEMICALS | 90 |
| Tetrahydrofuran | 90 |
| Reactive silicone compound having a radical polymerizing functional group<br>Bi-terminal methacryl-modified polysiloxane X-22-164A from Shin-Etsu Chemical Co., Ltd. having a molecular weight of 860 | 10 |
| Particulate filler<br>Alumina filler AA03 from Sumitomo Chemical Co., Ltd. | 20 |

Comparative Example 1

The procedure for preparation of the electrophotographic photoreceptor in Example 1 was repeated to prepare an electrophotographic photoreceptor with the exception of excluding the reactive silicone compound having a radical polymerizing functional group.

Comparative Example 2

The procedure for preparation of the electrophotographic photoreceptor in Example 1 was repeated to prepare an electrophotographic photoreceptor with the exception of excluding the radical polymerizing monomer having three or more functional groups without a charge transporting structure.

Comparative Example 3

The procedure for preparation of the electrophotographic photoreceptor in Example 1 was repeated to prepare an electrophotographic photoreceptor with the exception of excluding the radical polymerizing compound having one functional group with a charge transporting structure.

Comparative Example 4

The procedure for preparation of the electrophotographic photoreceptor in Example 1 was repeated to prepare an electrophotographic photoreceptor with the exception of changing the radical polymerizing monomer having three or more functional groups without a charge transporting structure to the following material.

Radical polymerizing monomer having the following formula without a charge transporting structure 90

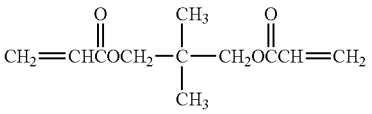

Bifunctional acrylate KAYARAD NPGDA having a molecular weight (Mw) of 212, 2 functional groups (Fg), and a ratio (Mw/Fg) of 106 from Nippon Kayaku Co., Ltd.

Comparative Example 5

The procedure for preparation of the electrophotographic photoreceptor in Example 1 was repeated to prepare an electrophotographic photoreceptor with the exception of changing the radical polymerizing compound having one functional group with a charge transporting structure to the following material.

Radical polymerizing compound having the following formula with a charge transporting structure 90

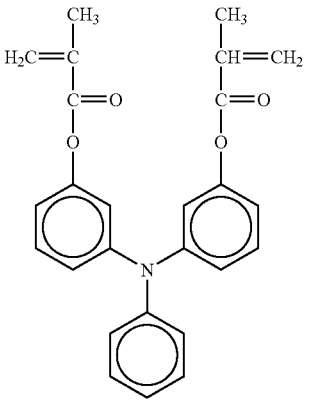

Comparative Example 6

The procedure for preparation of the electrophotographic photoreceptor in Example 1 was repeated to prepare an electrophotographic photoreceptor with the exception of changing the reactive silicone compound having a radical polymerizing functional group to the following material.

Methylphenyl silicone oil without a radical Polymerizing functional group KF50-100CS from Shin-Etsu Chemical Co., Ltd.

Comparative Example 7

The procedure for preparation of the electrophotographic photoreceptor in Example 1 was repeated to prepare an electrophotographic photoreceptor with the exception of excluding the crosslinked surface layer and forming the CTL so as to have a thickness of 27 μm.

Each of the thus prepared electrophotographic photoreceptors was installed in a process cartridge, and the process cartridge was installed in a modified imagio MF2200 using a DC contact charging roller and a LD having a wavelength of 655 nm as a imagewise light source from Ricoh Company, Ltd. After dark space potential was set at 700 (-V), 50,000 images were continuously produced to evaluate abrasion resistance and potential of the photoreceptor, and image quality. The evaluation results are shown in Tables 3, 4 and 5. In addition, as for each of Examples 1,2,3,4 and 6, ten points average roughness (Rz) was measured by surface roughness measurer SURF COM 1400D from TOKYO SEIMITSU CO., LTD. The results are shown in Table 6.

Further, as for each of Examples 1, 3, 8 and 10 and Comparative Examples 1 and 6, a contact angle against deionized water was measured by an automatic contact angle measurer CA-W from Kyowa Interface Science Co., Ltd. at the beginning and after 10,000 images were produced. The evaluation results are shown in Table 7.

TABLE 3

| | Abraded Amount (μm) | | | |
|---|---|---|---|---|
| | 10k | 30k | 50k | Remarks |
| Ex. 1 | 0.23 | 0.69 | 1.14 | |
| Ex. 2 | 0.24 | 0.71 | 1.21 | |
| Ex. 3 | 0.22 | 0.67 | 1.13 | |
| Ex. 4 | 0.23 | 0.68 | 1.16 | |
| Ex. 5 | 0.21 | 0.65 | 1.05 | |
| Ex. 6 | 0.26 | 0.73 | 1.31 | |
| Ex. 7 | 0.21 | 0.63 | 1.03 | |
| Ex. 8 | 0.26 | 0.70 | 1.34 | |
| Ex. 9 | 0.36 | 0.69 | 1.83 | |
| Ex. 10 | 0.24 | 0.73 | 1.35 | |
| Ex. 11 | 0.23 | 0.70 | 1.18 | |
| Ex. 12 | 0.18 | 0.53 | 0.93 | |
| Com. Ex. 1 | 0.30 | 0.88 | 1.58 | Black stripes appeared after 30k images were produced |
| Com. Ex. 2 | A surface layer could not be formed | | | |
| Com. Ex. 3 | 0.29 | 0.59 | — | Background fouling occurred and image production was stopped |
| Com. Ex. 4 | 0.48 | 1.45 | 2.45 | |
| Com. Ex. 5 | 0.46 | 1.46 | 2.46 | |
| Com. Ex. 6 | 0.30 | 0.61 | | Black stripes appeared after 30k images were produced |
| Com. Ex. 7 | 1.21 | 3.70 | 5.44 | |

TABLE 4

| | Potential (-V) | | | | | | | |
|---|---|---|---|---|---|---|---|---|
| | InitIal | | 10k | | 30k | | 50k | |
| | Dark | Bright | Dark | Bright | Dark | Bright | Dark | Bright |
| Ex. 1 | 700 | 80 | 695 | 80 | 690 | 80 | 690 | 85 |
| Ex. 2 | 700 | 80 | 695 | 80 | 695 | 80 | 695 | 80 |
| Ex. 3 | 700 | 75 | 695 | 75 | 695 | 75 | 690 | 70 |
| Ex. 4 | 700 | 90 | 700 | 90 | 705 | 95 | 700 | 90 |
| Ex. 5 | 700 | 80 | 695 | 80 | 690 | 80 | 690 | 80 |
| Ex. 6 | 700 | 85 | 695 | 90 | 690 | 85 | 690 | 85 |
| Ex. 7 | 700 | 85 | 700 | 80 | 695 | 80 | 690 | 85 |
| Ex. 8 | 700 | 80 | 695 | 85 | 690 | 85 | 695 | 85 |
| Ex. 9 | 700 | 85 | 695 | 80 | 690 | 80 | 690 | 80 |
| Ex. 10 | 700 | 85 | 695 | 80 | 690 | 80 | 685 | 75 |
| Ex. 11 | 700 | 85 | 695 | 80 | 680 | 80 | 675 | 75 |
| Ex. 12 | 700 | 100 | 700 | 115 | 705 | 120 | 705 | 120 |
| Com. Ex. 1 | 700 | 85 | 695 | 90 | 690 | 85 | | |
| Com. Ex. 2 | A surface layer could not be formed | | | | | | | |
| Com. Ex. 3 | 700 | 250 | 685 | 350 | 655 | 450 | — | — |
| Com. Ex. 4 | 700 | 90 | 695 | 105 | 690 | 110 | 695 | 115 |
| Com. Ex. 5 | 700 | 95 | 690 | 110 | 695 | 120 | 690 | 120 |
| Com. Ex. 6 | 700 | 80 | 685 | 80 | 690 | 80 | — | |
| Com. Ex. 7 | 700 | 80 | 685 | 75 | 670 | 70 | 665 | 65 |

TABLE 5

| | Image evaluation | | | | | | | |
|---|---|---|---|---|---|---|---|---|
| | Image density | | | | Defective image | | | |
| | Initial | 10k | 30k | 50k | Initial | 10k | 30k | 50k |
| Ex. 1 | ○ | ○ | ○ | ○ | ○ | ○ | ○ | ○ |
| Ex. 2 | ○ | ○ | ○ | ○ | ○ | ○ | ○ | ○ |
| Ex. 3 | ○ | ○ | ○ | ○ | ○ | ○ | ○ | ○ |
| Ex. 4 | ○ | ○ | ○ | ○ | ○ | ○ | ○ | ○ |
| Ex. 5 | ○ | ○ | ○ | ○ | ○ | ○ | ○ | ○ |
| Ex. 6 | ○ | ○ | ○ | ○ | ○ | ○ | ○ | ○ |
| Ex. 7 | ○ | ○ | ○ | ○ | ○ | ○ | ○ | ○ |
| Ex. 8 | ○ | ○ | ○ | ○ | ○ | ○ | ○ | ○ |
| Ex. 9 | ○ | ○ | ○ | ○ | ○ | ○ | ○ | ○ |
| Ex. 10 | ○ | ○ | ○ | ○ | ○ | ○ | ○ | ○ |
| Ex. 11 | ○ | ○ | ○ | ○ | ○ | ○ | ○ | ○ |
| Ex. 12 | ○ | ○ | Δ | Δ | ○ | ○ | ○ | ○ |
| Com. Ex. 1 | ○ | ○ | Δ | Δ | ○ | ○ | Δ | Δ |
| Com. Ex. 2 | A surface layer could not be formed | | | | | | | |
| Com. Ex. 3 | Δ | x | x | — | ○ | x | x | — |
| Com. Ex. 4 | ○ | ○ | Δ | Δ | ○ | ○ | Δ | Δ |
| Com. Ex. 5 | ○ | ○ | Δ | Δ | ○ | ○ | Δ | Δ |
| Com. Ex. 6 | ○ | ○ | Δ | — | ○ | ○ | Δ | — |
| Com. Ex. 7 | ○ | Δ | x | x | ○ | Δ | Δ | x |

Image density:
○ good
Δ slightly deteriorated
x deteriorated
Defective image:
○ good
Δ locally occurred
x overall occurred

TABLE 6

| | Reactive functional group | Molecular weight | Viscosity | Rz/μm |
|---|---|---|---|---|
| Example 1 | Methacryloyloxy | 860 | 24.5 mPa•s 25° C. | 0.26 |
| Example 2 | Methacryloyloxy | 2,100 | 24.5 mPa•s 25° C. | 0.64 |
| Example 3 | Acryloyloxy | — | — | 0.30 |
| Example 4 | Acryloyloxy | — | 13.0 mPa•s 25° C. | 0.21 |
| Example 6 | Methacryloyloxy | 5,000 | 58.8 mPa•s 25° C. | 0.95 |

TABLE 7

| | Initial | After 10k images |
|---|---|---|
| Example 1 | 101.3 | 76.4 |
| Example 3 | 100.3 | 75.4 |
| Example 8 | 100.7 | 75.2 |
| Example 10 | 99.8 | 74.8 |
| Comparative Example 1 | 79.3 | 65.1 |
| Comparative Example 6 | 101.3 | 66.0 |

Neither of photoreceptors in Comparative Examples 1, 4, 6 and 7 could maintain high abrasion resistance and producing high quality images. In Comparative Example 2, a crosslinked surface layer could not be formed.

As Table 6 shows, the photoreceptors including a reactive silicone compound having an acryloyloxy group have a small Rz and have good surface smoothness. In addition, a reactive silicone having a small molecular weight and a small viscosity has a small Rz.

As Table 7 shows, a reactive silicone compound improves continuousness of low surface energy.

Having now fully described the invention, it will be apparent to one of ordinary skill in the art that many changes and modifications can be made thereto without departing from the spirit and scope of the invention as set forth therein.

The invention claimed is:

1. An electrophotographic photoreceptor comprising:

an electroconductive substrate; and a photosensitive layer located overlying the electroconductive substrate, wherein an outermost layer of the electrophotographic photoreceptor is a crosslinked layer, obtained from components comprising:

a radical polymerizing monomer having three or more functional groups without a charge transporting structure;

a radical polymerizing compound having one functional group with a charge transporting structure; and a reactive silicone compound according to the following general formula (I):

(I)

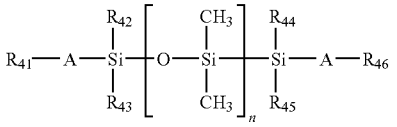

wherein $R_{41}$ represents a radical polymerizing functional group;

$R_{42}$, $R_{43}$, $R_{44}$ and $R_{45}$ independently represent a hydrogen atom, an alkyl group having from 1 to 12 carbon atoms or an aryl group having from 1 to 12 carbon atoms;

$R_{46}$ represents a hydrogen atom, an alkyl group having from 1 to 12 carbon atoms, an aryl group having from 1 to 12 carbon atoms or a radical polymerizing functional group;

A represents a single bond or an alkylene group having from 2 to 6 carbon atoms; and n represents an integer of not less than 2, and wherein the reactive silicone compound has a viscosity of not greater than 20 Pa·s at 25° C.

2. The electrophotographic photoreceptor of claim 1, wherein the reactive silicone compound has a molecular weight not greater than 10,000.

3. The electrophotographic photoreceptor of claim 1, wherein the crosslinked layer includes the reactive silicone compound in an amount of from 0.05 to 20 % by weight based on total weight of a solid content of a coating liquid for forming the crosslinked layer.

4. The electrophotographic photoreceptor of claim 1, wherein the three or more functional groups of the radical polymerizing monomer without a charge transporting structure are acryloyloxy groups or methacryloyloxy groups.

5. The electrophotographic photoreceptor of claim 1, wherein the three or more functional groups of the radical polymerizing monomer without a charge transporting structure has a ratio (Mw/Fg) of a molecular weight (Mw) to the number of the functional groups (Fg) not greater than 250.

6. The electrophotographic photoreceptor of claim 1, wherein the one functional group of the radical polymerizing compound with a charge transporting structure is an acryloyloxy group or a methacryloyloxy group.

7. The electrophotographic photoreceptor of claim 1, wherein the charge transporting structure of the radical polymerizing compound having one functional group is a triarylamine structure.

8. The electrophotographic photoreceptor of claim 1, wherein the radical polymerizing compound having one functional group with a charge transporting structure is at least one of compounds having the following formulae (1) and (2):

(1)

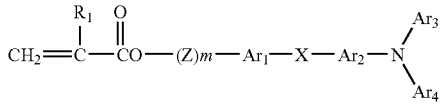

(2)

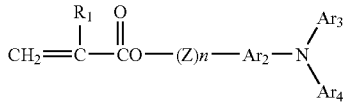

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group;

$Ar_1$ and $Ar_2$ independently represent a substituted or an unsubstituted arylene group;

$Ar_3$ and $Ar_4$ independently represent a substituted or an unsubstituted aryl group;

X represents a single bond, a substituted or an unsubstituted alkylene group, a substituted or an unsubstituted cycloalkylene group, a substituted or an unsubstituted alkyleneether group, an oxygen atom, a sulfur atom and vinylene group;

Z represents a substituted or an unsubstituted alkylene group, a substituted or an unsubstituted alkyleneether group and alkyleneoxycarbonyl group; and m and n represent 0 and an integer of from 1 to 3.

9. The electrophotographic photoreceptor of claim 1, wherein the radical polymerizing compound having one functional group with a charge transporting structure is at least one of compounds having the following formula (3):

(3)

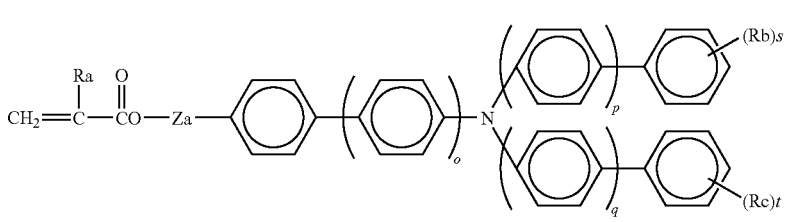

wherein o, p and q independently represent 0 or 1;

Ra represents a hydrogen atom or a methyl group;

Rb and Rc represents a substituent besides a hydrogen atom and an alkyl group having 1 to 6 carbon atoms, and may be different from each other when having plural carbon atoms;

s and t represent 0 or an integer of from 1 to 3; and

Za represents a single bond, a methylene group, ethylene group,

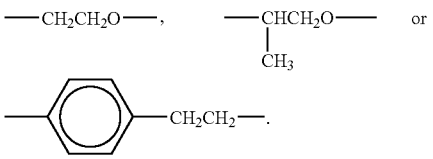

10. The electrophotographic photoreceptor of claim 1, wherein a particulate filler is dispersed in the outermost layer.

11. The electrophotographic photoreceptor of claim 1, wherein the outermost layer is hardened upon application of heat or light.

12. The electrophotographic photoreceptor of claim 1, wherein $R_{46}$ represents a radical polymerizing functional group selected from the group consisting of an acryloyloxy group and a methacryloyloxy group.

13. The electrophotographic photoreceptor of claim 1, wherein the radical polymerizing functional group of the reactive silicone compound is an acryloyloxy group or a methacryloyloxy group.

14. The electrophotographic photoreceptor of claim 13, wherein the reactive silicone compound includes two or more acryloyloxy groups.

15. An electrophotographic image forming method for interatively forming an image, comprising:

charging a photoreceptor, said photoreceptor comprising:

an electroconductive substrate; and a photosensitive layer located overlying the electroconductive substrate, wherein an outermost layer of the electrophotographic photoreceptor is a crosslinked layer, obtained from components comprising:

a radical polymerizing monomer having three or more functional groups without a charge transporting structure;

a radical polymerizing compound having one functional group with a charge transporting structure; and a reactive silicone compound according to the following general formula (I):

(I)

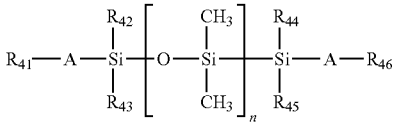

wherein $R_{41}$ represents a radical polymerizing functional group;

$R_{42}$, $R_{43}$, $R_{44}$ and $R_{45}$ independently represent a hydrogen atom, an alkyl group having from 1 to 12 carbon atoms or an aryl group having from 1 to 12 carbon atoms;

$R_{46}$represents a hydrogen atom, an alkyl group having from 1 to 12 carbon atoms, an aryl group having from 1 to 12 carbon atoms or a radical polymerizing functional group;

A represents a single bond or an alkylene group having from 2 to 6 carbon atoms; and n represents an integer of not less than 2, and wherein the reactive silicone compound has a viscosity of not greater than 20 Pa·s at 25° C.;

irradiating the photoreceptor with light to form an electrostatic latent image on a surface of the photoreceptor;

developing the electrostatic latent image with a toner to form a toner image on the photoreceptor; and transferring the toner image onto a receiving material.

16. The electrophotographic image forming method of claim 15, wherein $R_{46}$ represents a radical polymerizing functional group selected from the group consisting of an acryloyloxy group and a methacryloyloxy group.

17. An electrophotographic image forming apparatus comprising:

a photoreceptor, comprising:

an electroconductive substrate; and a photosensitive layer located overlying the electroconductive substrate, wherein an outermost layer of the electrophotographic photoreceptor is a crosslinked layer, obtained from components comprising:

a radical polymerizing monomer having three or more functional groups without a charge transporting structure;

a radical polymerizing compound having one functional group with a charge transporting structure; and a reactive silicone compound according to the following general formula (I):

(I)

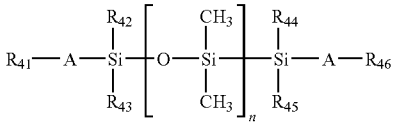

wherein $R_{41}$ represents a radical polymerizing functional group;

$R_{42}$,$R_{43}$, $R_{44}$ and R45 independently represent a hydrogen atom, an alkyl group having from 1 to 12 carbon atoms or an aryl group having from 1 to 12 carbon atoms;

$R_{46}$ represents a hydrogen atom, an alkyl group having from 1 to 12 carbon atoms, an aryl group having from 1 to 12 carbon atoms or a radical polymerizing functional group;

A represents a single bond or an alkylene group having from 2 to 6 carbon atoms; and n represents an integer of not less than 2, and wherein the reactive silicone compound has a viscosity of not greater than 20 Pa·s at 25° C.;

a charger configured to charge the photoreceptor;

an irradiator configured to irradiate the photoreceptor with light to form an electrostatic latent image on the photoreceptor;

an image developer configured to develop the electrostatic latent image with a toner to form a toner image on the photoreceptor; and a transferer configured to transfer the toner image onto a receiving material.

18. The electrophotographic image forming apparatus of claim 17, wherein $R_{46}$ represents a radical polymerizing functional group selected from the group consisting of an acryloyloxy group and a methacryloyloxy group.

19. A process cartridge for an image forming apparatus comprising:

an electrophotographic photoreceptor, comprising:

an electroconductive substrate; and a photosensitive layer located overlying the electroconductive substrate, wherein an outermost layer of the electrophotographic photoreceptor is a crosslinked layer, obtained from components comprising:

a radical polymerizing monomer having three or more functional groups without a charge transporting structure;

a radical polymerizing compound having one functional group with a charge transporting structure; and a reactive silicone compound according to the following general formula (I):

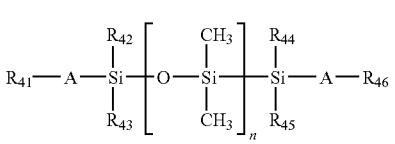

(I)

wherein $R_{41}$ represents a radical polymerizing functional group;

$R_{42}$,$R_{43}$, $R_{44}$ and $R_{45}$ independently represent a hydrogen atom, an alkyl group having from 1 to 12 carbon atoms or an aryl group having from 1 to 12 carbon atoms;

$R_{46}$ represents a hydrogen atom, an alkyl group having from 1 to 12 carbon atoms, an aryl group having from 1 to 12 carbon atoms or a radical polymerizing functional group;

A represents a single bond or an alkylene group having from 2 to 6 carbon atoms; and n represents an integer of not less than 2, and wherein the reactive silicone compound has a viscosity of not greater than 20 Pa·s at 25° C.; and at least one member selected from the group consisting of chargers, image developers, transferers, cleaners and dischargers, wherein the process cartridge is detachable with the image forming apparatus.

20. The process cartridge for an image forming apparatus of claim 19, wherein $R_{46}$ represents a radical polymerizing functional group selected from the group consisting of an acryloyloxy group and a methacryloyloxy group.

* * * * *